United States Patent [19]

Trokhan

[11] Patent Number: 5,073,235

[45] **Date of Patent: * Dec. 17, 1991**

[54] PROCESS FOR CHEMICALLY TREATING PAPERMAKING BELTS

[75] Inventor: Paul D. Trokhan, Hamilton, Ohio

[73] Assignee: The Procter & Gamble Company, Cincinnati, Ohio

[ * ] Notice: The portion of the term of this patent subsequent to Oct. 22, 2008 has been disclaimed.

[21] Appl. No.: 508,879

[22] Filed: Apr. 12, 1990

[51] Int. Cl.[5] ..... D21F 1/00

[52] U.S. Cl. ..... 162/199; 162/DIG. 4

[58] Field of Search ..... 162/199, DIG. 4; 252/400.24, 401, 404, 406; 264/136; 427/384

[56] References Cited

U.S. PATENT DOCUMENTS

| | | | |
|---|---|---|---|
| 2,594,384 | 4/1952 | Benignus | 117/138.5 |
| 3,137,613 | 6/1964 | Backman et al. | 162/199 |
| 3,150,035 | 9/1964 | Eddy | 162/199 |
| 3,459,633 | 8/1969 | West | 162/199 |
| 4,514,345 | 4/1985 | Johnson et al. | 264/22 |
| 4,526,918 | 7/1985 | Burton | 524/150 |
| 4,528,239 | 7/1985 | Trokhan | 428/247 |
| 4,529,480 | 7/1985 | Trokhan | 162/109 |
| 4,569,883 | 2/1986 | Renjilian | 428/234 |
| 4,637,859 | 1/1987 | Trokhan | 162/109 |
| 4,728,530 | 3/1988 | Waldvogel | 162/DIG. 1 |
| 4,847,116 | 7/1989 | Duit | 427/195 |

OTHER PUBLICATIONS

Capolupo and Chucta, "Antioxidants", Modern Plastics Encyclopedia, pp. 127–128 (1988).

Bayer, "A Review of Ultraviolet Curing Technology", Tappi Paper Synthetics Conf. Proc., Sep. 25–27, pp. 167–172 (1978).

*Primary Examiner*—Richard V. Fisher
*Assistant Examiner*—Charles K. Friedman
*Attorney, Agent, or Firm*—Bart S. Hersko; Jeffrey V. Bamber; Fred H. Braun

[57] ABSTRACT

A process for improving the life of papermaking belts containing a cured photosensitive polymeric resin is disclosed. The process includes the continuous application of an effective amount of chemical compounds capable of slowing down the degradation rate of the photosensitive polymeric resin to the belt's surface during the papermaking operation. Preferably, the chemical compounds are antioxidants which inhibit or retard oxidation of the cured resin and its ensuing degradative effects.

12 Claims, 9 Drawing Sheets

PROCESS FOR CHEMICALLY TREATING PAPERMAKING BELTS

FIELD OF THE INVENTION

The present invention generally relates to processes for making strong, soft, absorbent paper products. This invention is also concerned with a papermaking belt which is used in this process, and a method of making such a papermaking belt. More particularly, this invention is concerned with a papermaking process which employs a photosensitive polymeric resin coated papermaking belt and a method of chemically treating the resin coated belt during the papermaking operation.

BACKGROUND OF THE INVENTION

One pervasive feature of daily life in modern industrialized societies is the use of disposable products, particularly disposable products made of paper. Paper towels, facial tissues, sanitary tissues, and the like are in almost constant use. Naturally, the manufacture of items in such great demand has become, in the Twentieth Century, one of the largest industries in industrially developed countries. The general demand for disposable paper products has, also naturally, created a demand for improved versions of the products and of the methods of their manufacture. Despite great strides in paper making, research and development efforts continue to be aimed at improving both the products and their processes of manufacture.

Disposable products such as paper towels, facial tissues, sanitary tissues, and the like are made from one or more webs of tissue paper. If the products are to perform their intended tasks and to find wide acceptance, they, and the tissue paper webs from which they are made, must exhibit certain physical characteristics. Among the more important of these characteristics are strength, softness, and absorbency.

Strength is the ability of a paper web to retain its physical integrity during use.

Softness is the pleasing tactile sensation consumers perceive when they crumple the paper in their hands and when they use the paper for its intended purposes.

Absorbency is the characteristic of the paper which allows it to take up and retain fluids, particularly water and aqueous solutions and suspensions. In evaluating the absorbency of paper, not only is the absolute quantity of fluid a given amount of paper will hold significant, but the rate at which the paper will absorb the fluid is also important. In addition, when the paper is formed into a device such as a towel or wipe, the ability of the paper to cause a fluid to be taken up into the paper and thereby leave a dry wiped surface is also important.

Processes for the manufacturing of disposable paper products for use in tissue, toweling and sanitary products generally involve the preparation of an aqueous slurry of paper fibers and then subsequently removing the water from the slurry while contemporaneously rearranging the fibers in the slurry to form a paper web. Various types of machinery can be employed to assist in the dewatering process. Currently, most manufacturing processes employ machines which are known as Fourdrinier wire papermaking machines or machines which are known as twin (Fourdrinier) wire papermachines. In Fourdrinier wire papermaking machines, the paper slurry is fed onto the top surface of a traveling endless belt, which serves as the initial papermaking surface of the machine. In twin wire machines, the slurry is deposited between a pair of converging Fourdrinier wires in which the initial dewatering and rearranging in the papermaking process are carried out. After the initial forming of the paper web on the Fourdrinier wire or wires, both types of machines generally carry the paper web through a drying process or processes on another fabric in the form of an endless belt which is often different from the Fourdrinier wire or wires. This other fabric is sometimes referred to as a drying fabric. Numerous arrangements of the Fourdrinier wire(s) and the drying fabric(s) as well as the drying process(es) have been used successfully and somewhat less than successfully. The drying process(es) can involve mechanical compaction of the paper web, vacuum dewatering, drying by blowing heated air through the paper web, and other types of drying processes.

As seen above, papermaking belts or fabrics carry various names depending on their intended use. Fourdrinier wires, also known as Fourdrinier belts, forming wires, or forming fabrics are those which are used in the initial forming zone of the papermaking machine. Dryer fabrics as noted above, are those which carry the paper web through the drying operation of the papermaking machine. Various other types of belts or fabrics are possible also. Most papermaking belts employed in the past are commonly formed from a length of woven fabric the ends of which have been joined together in a seam to form an endless belt. Woven papermaking fabrics generally comprise a plurality of spaced longitudinal warp threads and a plurality of spaced transverse weft threads which have been woven together in a specific weaving pattern. Prior belts have included single layer (of warp and weft threads) fabrics, multilayered fabrics, and fabrics with several layers of interwoven warp and weft threads. Initially, the threads of papermaking fabrics were made from wires comprised of materials such as bronze, stainless steel, brass or combinations thereof. Often various materials were placed on top of and affixed to the fabrics in an attempt to make the dewatering process more efficient. Recently, in the papermaking field, it has been found that synthetic materials may be used in whole or part to produce the underlying wire structures, which would be superior in quality to the forming wires made of metal threads. Such synthetic materials have included nylon, polyesters, acrylic fibers and copolymers. While many different processes, fabrics, and arrangements of these fabrics have been used, only certain of these processes, fabrics, and arrangements of these fabrics have resulted in commercially successful paper products.

An example of paper webs which have been widely accepted by the consuming public is the webs made by the process described in U.S. Pat. No. 3,301,746, Sanford and Sisson, issued Jan. 31, 1967. Other widely accepted paper products are made by the process described in U.S. Pat. No. 3,994,771, Morgan and Rich, issued Nov. 30, 1976. Despite the high quality of products made by these two processes, however, the search for still improved products has, as noted above, continued.

Another commercially significant improvement was made upon the above paper webs by the process described in U.S. Pat. No. 4,529,480, Trokhan, issued July 16, 1985. The improvement included utilizing a papermaking belt (termed a "deflection member") which was comprised of a foraminous woven member surrounded by a hardened photosensitive resin framework. The resin framework was provided with a plurality of discrete, isolated, channels known as "deflection conduits". The process in which this deflection member was used involved, among other steps, associating an embryonic web of papermaking fibers with the top surface of the deflection member and applying a vacuum or other fluid pressure differential to the web from the backside (machine-contacting side) of the deflection member. The papermaking belt used in this process was termed a "deflection member" because the papermaking fibers would be deflected into and rearranged into the deflection conduits of the hardened resin framework upon the application of the fluid pressure differential. The deflection member was made according to the process described in U.S. Pat. No. 4,514,345, Johnson et al., issued Apr. 30, 1985. This process included the steps of: 1) coating the foraminous woven element with a photosensitive resin; 2) controlling the thickness of the photosensitive resin to a pre-selected value; 3) exposing the resin to a light having an activated wave length through a mask having opaque and transparent regions; and 4) removing the uncured resin. By utilizing the aforementioned improved papermaking process, it was finally possible to create paper having certain desired pre-selected characteristics. The paper produced using the process disclosed in U.S. Pat. No. 4,529,480 is characterized by having two physically distinct regions distributed across its surface; one is a continuous network region which has a relatively high density and high intrinsic strength, the other is a region which is comprised of a plurality of domes which have relatively low densities and relatively low intrinsic strengths (when compared to the network region), which are completely encircled by the network region.

The paper produced by the aforementioned process was actually stronger, softer, and more absorbent than the paper produced by the preceding processes as a result of several factors. The strength of the paper produced was increased as a result of the relatively high intrinsic strength provided by the network region. The softness of the paper produced was increased as a result of the provision of the plurality of low density domes across the surface of the paper. The absorbency of the paper was increased due to the fact that the paper had a generally lower density, whereas the rate of absorbency was increased because the network was able to distribute absorbed liquids to the absorbent low density domes in an orderly fashion.

Although the aforementioned improved process worked quite well, it has been found that the hardened photosensitive polymeric resin contained in the papermaking belt rapidly degrades with time resulting in the belts failing prematurely. The principle degradation mechanism for these deflection members (papermaking belts) is oxidation of the photopolymer resin. To retard this, it is necessary to add antioxidant chemicals, such as high molecular weight hindered phenols, to the liquid photopolymer resin prior to final polymerization by light of an activating wave length (e.g., UV light). However, there is an upper limit to the amount of these chemicals that can be included in the liquid resin for three reasons: (a) these chemicals have a negative impact on the photospeed (reaction rate) of the resin, (b) solubility limitations of the chemicals in the resin, and (c) the resin structure is weakened by displacement of the polymer. While running on a paper machine, these materials are consumed and/or removed as they protect against oxidation. As the antioxidant content is lowered or eliminated, the resin becomes vulnerable to degradation and the belt is soon destroyed. Thus, a need exists for a method of replacing the chemical compounds which are depleted from the belt during the papermaking operation.

The present invention pertains to a process for improving the useful belt life through the continuous application of chemical compounds to the solid polymeric resin containing belts during the papermaking operation. In particular, by adding appropriate antioxidant chemicals to the belt during the papermaking operation, the belt life can be greatly extended. This technique overcomes the current limitation on the amount of antioxidants that can be added to the unpolymerized liquid resin. It also counteracts the natural depletion of antioxidant in the resin during normal papermaking operations.

It is an object of this invention to provide a process for extending the operating life of papermaking belts containing a solid polymeric photosensitive resin through the continuous application of an effective amount of a chemical compound to the papermaking belt during the papermaking operation.

It is another object of the present invention to provide a process for the continuous application of low levels of antioxidant chemicals to the paper-contacting surface of these resin containing papermaking belts during their use; thereby protecting the resin against oxidation.

These and other objects are obtained using the present invention, as will be seen from the following disclosure.

SUMMARY OF THE INVENTION

The invention encompasses a process for improving the belt life of papermaking belts containing solid photosensitive polymeric resins; and an improved process for making paper using these types of papermaking belts. Generally, the improvement in belt life results from the continuous application of an effective amount of chemical compound(s) to the belt during the papermaking operation. Preferably, the chemical compounds are antioxidants which can inhibit or retard oxidation of the polymeric resins and the ensuing degradative effects.

The papermaking belt, in its preferred form, is comprised of two primary components: (1) a solid polymeric resin framework, which has been rendered solid by exposing a liquid photosensitive resin to light of an activating wavelength, and which has a first surface for contacting the fiber webs to be dewatered, and a second surface, opposite the first surface for contacting the dewatering machinery employed in the dewatering operation; and (2) a reinforcing structure having interstices therein, which can be a foraminous woven member, for reinforcing the resin framework positioned between the first surface of the framework and at least a portion of the second surface of the framework. Preferably, the resin framework has a plurality of conduits therein for channeling water from the first surface through the resin framework to the second surface.

Suitable photosensitive resins can be readily selected from the many available commercially. Examples of photosensitive polymeric resins include: urethane acrylates (e.g., methacrylated-urethane), styrene butadiene copolymers, acrylic esters, epoxy acrylates, acrylated aromatic urethanes, and acrylated polybutadienes. Especially preferred liquid photosensitive resins are included in the Merigraph series of methacrylated-urethane resins made by Hercules Incorporated, Wilmington, Del. A most preferred resin is Merigraph resin EPD 1616B.

In the preferred process of carrying out the present invention, antioxidants are continuously applied to the papermaking belts during the papermaking operation to protect the papermaking belts from oxidation and increase the life of the papermaking belt. Surprisingly, it has been found that antioxidants will be absorbed by the papermaking belt when applied to the belt while is use. This is unexpected because the high speed papermaking belts make one complete revolution in approximately three seconds, with the belts passing through cleaning showers and over fluid removing vacuum boxes every revolution. Thus, typically the antioxidant chemicals have less than three seconds to be absorbed by the resin or be adhered to the resin's surface (before being rinsed off by the cleaning showers and/or removed by the vacuum boxes) and make the belt more resistant to oxidation.

Suitable antioxidants can be readily selected from the many available commercially. The preferred antioxidants are primary antioxidants, such as hindered phenols, which are capable of scavenging free radicals and interrupting oxidative chain reactions. A more detailed description of the types of antioxidants suitable for use in the present invention is provided hereinafter.

The present invention also relates to a process for making paper using the papermaking belts of the present invention. The process for making a paper web according to the present invention comprises:

(a) providing an aqueous dispersion of papermaking fibers;

(b) forming an embryonic web of papermaking fibers from the aqueous dispersion on a foraminous member;

(c) contacting the embryonic web with a papermaking belt comprising a framework having a paper-contacting first surface, a second surface opposite the first surface, and conduits extending from the first surface to the second surface; and, a reinforcing structure for reinforcing the framework, positioned between the first surface of the framework and at least a portion of the second surface of the framework, the reinforcing structure having a reinforcing component with interstices therein;

(d) deflecting at least a portion of the papermaking fibers in the embryonic web into the conduits, and removing water from the embryonic web through the conduits and rearranging the papermaking fibers to form an intermediate web under such conditions that said deflecting is initiated no later that the initiation of said water removal;

(e) predrying the intermediate web in association with the papermaking belt to a consistency of from about 25% to about 98% to form a predried web of papermaking fibers.

In conjunction with the above described papermaking process, an effective amount of a chemical compound, preferably an emulsion containing a dissolved antioxidant chemical, is continuously applied to the belt during the papermaking operation. This process of continuously adding chemical compounds to the papermaking belts while in use will be described in more detail hereinafter.

All percentages, ratios and proportions herein are by weight, unless otherwise specified.

DETAILED DESCRIPTION OF THE INVENTION

While this specification concludes with claims particularly pointing out and distinctly claiming that which is regarded as the invention, it is believed that the invention can be more readily understood through perusal of the following detailed description of the invention in combination with study of the associated drawings and appended examples.

The specification is divided into four sections:

(1) detailed description of the process of papermaking and continuous application of chemical compounds to the papermaking belt of the present invention;

(2) description of paper webs produced using the papermaking process;

(3) description of preferred papermaking belts;

(4) description of methods used to make the preferred papermaking belts.

1. The Process for Makinq Paper and Adding Chemical Compounds to Belt

A detailed description of the process of the present invention for improving the belt life of papermaking belts containing solid photosensitive polymeric resins and process for making paper using these types of resin coated belts is provided below, although it is contemplated that other processes may also be used. A preferred process for making paper using the photosensitive resin coated papermaking belt of the present invention is set out in detail in U.S. Pat. No. 4,528,239 entitled "Deflection Member", which issued to Paul D. Trokhan on July 9, 1985, and in U.S. Pat. No. 4,529,480, entitled "Tissue Paper" which issued to Paul D. Trokhan on July 16, 1985, both of which are also incorporated by reference herein.

The overall papermaking process, including the process of this invention for chemically treating the resin coated belts, comprises a number of steps or operations which occur in time sequence as noted below. It is to be understood, however, that the steps described below are intended to assist the reader in understanding the process of the present invention, and that the present invention is not limited to processes with only a certain number or arrangement of steps. Each step will be discussed in detail in the following paragraphs in reference to FIG. 1.

Figure 1:
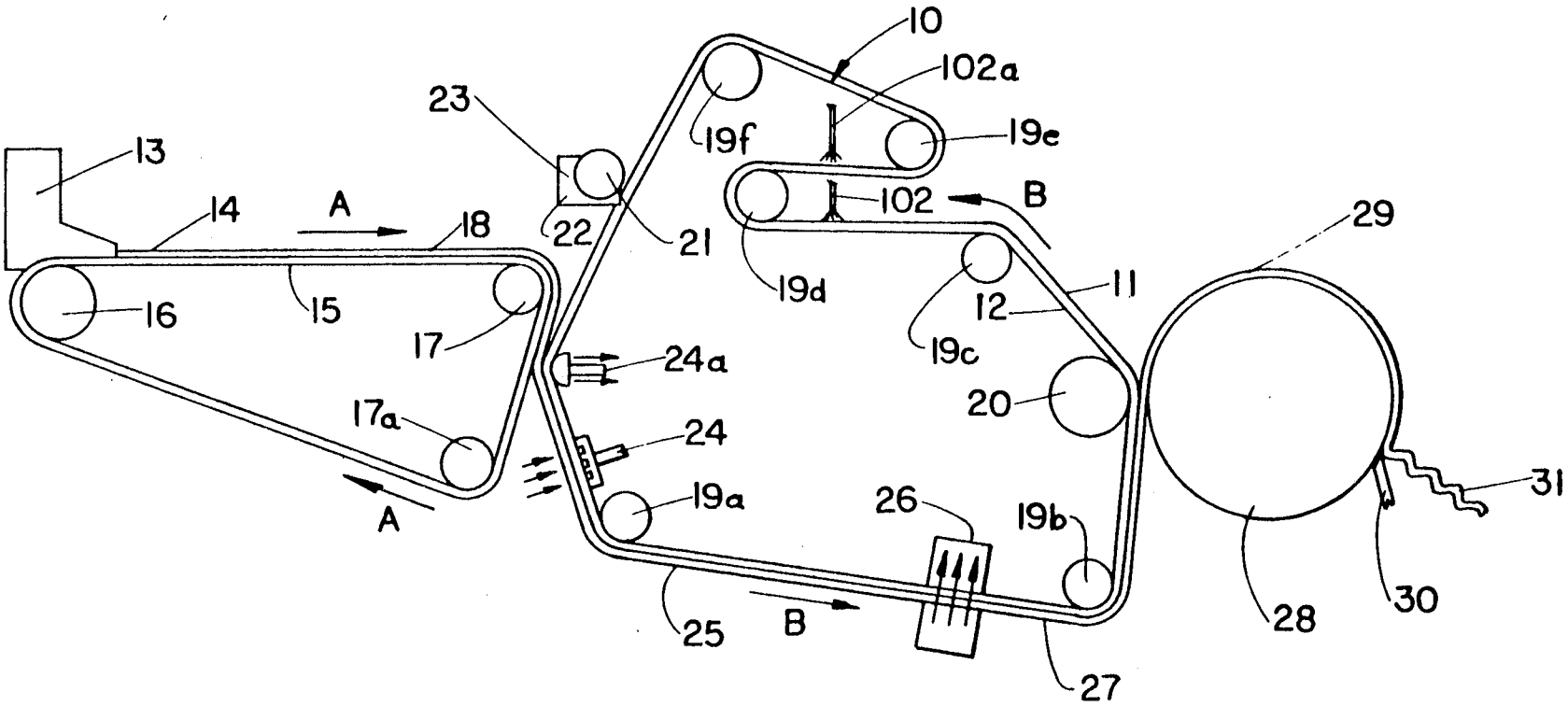
FIG. 1 is a schematic representation of one embodiment of a continuous papermaking machine which illustrates the process of the present invention of adding chemicals to a papermaking belt.

FIG. 1 is a simplified, schematic representation of one embodiment of a continuous papermaking machine useful in the practice of the present invention. The particular papermaking machine illustrated in FIG. 1 is a Fourdrinier wire machine which is generally similar in configuration and in the arrangement of its belts to the papermaking machine disclosed in U.S. Pat. No. 3,301,746, issued to Sanford and Sisson on Jan. 31, 1967, which is incorporated by reference herein. It is also contemplated that the twin wire papermaking machine illustrated in FIG. 1 of U.S. Pat. No. 4,102,737, issued to Morton on July 25, 1978 (which patent is also incorporated by reference herein) could be used to practice the present invention.

First Step

The first step in the practice of the papermaking process is the providing of an aqueous dispersion of papermaking fibers 14. Useful papermaking fibers include those cellulosic fibers commonly known as wood pulp fibers. Fibers derived from soft woods (gymnosperms or coniferous trees) and hard woods angiosperms or deciduous trees) are contemplated for use in this invention. The particular species of tree from which the fibers are derived is immaterial.

Cellulosic fibers of diverse natural origins may also be used, including cotton linter fibers, fibers from Esparto grass, bagasse, hemp, peat moss, and flax. Recycled cellulosic fibrous materials (e.g., wood pulp fiber) can be utilized and are intended to be within the scope of this invention. In addition, synthetic fibers, such as rayon, polyethylene and polypropylene fibers, may also be utilized in combination with natural cellulosic fibers. One exemplary polyethylene fiber which may be utilized is Pulpex TM, available from Hercules, Inc. (Wilmington, Del.).

The wood pulp fibers can be produced from the native wood by any convenient pulping process. Chemical processes such as sulfite, sulfate (including the Kraft) and soda processes are suitable. Mechanical processes, such as thermomechanical (or Asplund) processes, are also suitable. In addition, the various semi-chemical and chemi-mechanical processes can be used. Bleached as well as unbleached fibers are contemplated for use. When the paper web of this invention is intended for use in absorbent products such as paper towels, bleached northern softwood Kraft pulp fibers are preferred.

To prepare the aqueous dispersion of papermaking fibers, any equipment commonly used in the art for dispersing fibers can be used. The aqueous dispersion of papermaking fibers 14 is prepared in equipment not shown and is provided to headbox 13 which can be of any convenient design. From headbox 13 the aqueous dispersion of papermaking fibers 14 is delivered to a forming surface or forming belt, which is typically a Fourdrinier wire shown as 15, for carrying out the second step of the papermaking process. The Fourdrinier wire 15 is supported by a breast roll 16 and a plurality of return rolls designated 17 and 17*a*. The Fourdrinier wire 15 is propelled in the direction indicated by directional arrow A by a conventional drive means which is not shown in FIG. 1. Optional auxiliary units and devices which are commonly associated with papermaking machines and with Fourdrinier wires, including forming boards, hydrofoils, vacuum boxes, tension rolls, support rolls, wire cleaning showers, and the like, are also not shown in FIG. 1.

Normally, the fibers in the aqueous dispersion are dispersed at a consistency of from about 0.1 to about 0.3% at the end of the first step.

In addition to papermaking fibers, the aqueous dispersion can include various additives commonly used in papermaking. The list of possible additives contained in Column 4 lines 24–59 of U.S. Pat. No. 4,529,480 issued July 16, 1985, is incorporated herein by reference.

As used in this specification, the moisture content of various dispersions, webs, and the like is expressed in terms of percent consistency. Percent consistency is defined as 100 times the quotient obtained when the weight of dry fiber in the system under discussion is divided by the total weight of the system. As used herein, fiber weight is always expressed on the basis of bone dry fibers.

Second Step

The second step in the papermaking process is forming an embryonic web 18 of papermaking fibers on a foraminous surface (such as the Fourdrinier wire 15) from the aqueous dispersion 14 supplied in the first step.

As used in this specification, an embryonic web 18 is the web of fibers which is, during the course of the papermaking process, subjected to rearrangement on the papermaking belt 10 as hereinafter described.

The embryonic web 18 is formed from the aqueous dispersion of papermaking fibers 14 by depositing that dispersion onto a foraminous surface and removing a portion of the aqueous dispersing medium by techniques well known to those skilled in the art. Vacuum boxes, forming boards, hydrofoils, and the like are useful in effecting water removal. The fibers in the embryonic web 18 normally have a relatively large quantity of water associated with them, consistencies in the range of from about 5% to about 25% are common. Normally, an embryonic web 18 is too weak to be capable of existing without the support of an extraneous element such as a Fourdrinier wire 15. Regardless of the technique by which an embryonic web 18 is formed, at the time it is subjected to rearrangement on the papermaking belt 10 it must be held together by bonds weak enough to permit rearrangement of the fibers under the action of the forces hereinafter described.

Any of the numerous techniques well known to those skilled in the papermaking art can be used to form the embryonic web. The precise method by which the embryonic web 18 is formed is immaterial to the practice of this invention so long as the embryonic web 18 possesses the characteristics discussed above. As a practical matter, continuous papermaking processes are preferred, even though batch process, such as handsheet making processes, can be used. Processes which lend themselves to the practice of this step are described in many references such as U.S. Pat. No. 3,301,746 issued to Sanford and Sisson on Jan. 31, 1974, and U.S. Pat. No. 3,994,771 issued to Morgan and Rich on Nov. 30, 1976, both incorporated herein by reference. After the embryonic web 18 if formed, it travels with Fourdrinier wire 15 about the return roll 17 and is brought up into the proximity of a second papermaking belt, papermaking belt 10.

Third Step

The third step in the papermaking process is associating the embryonic web 18 with the papermaking belt 10 which is sometimes referred to in the previous patents, which are incorporated by reference herein, as the "deflection member" because of its function. The purpose of this third step is to bring the embryonic web 18 into contact with the papermaking belt 10 on which it will be subsequently deflected, rearranged, and further dewatered. The characteristics of the papermaking belt 10 are described in greater detail in the following section of this specification. At this point, however, it is noted that the papermaking belt 10 has a plurality of conduits, into which the fibers of the embryonic web 18 are deflected and rearranged.

In the embodiment illustrated in FIG. 1, the papermaking belt 10 of the present invention travels in the direction indicated by directional arrow B. The papermaking belt 10 passes around the papermaking belt return rolls designated 19*a* and 19*b*, impression nip roll 20, papermaking belt return rolls 19*c*, 19*d*, 19*e* and 19*f*, and emulsion distributing roll 21 (which distributes an emulsion 22 onto the papermaking belt 10 from an emulsion bath 23). In between papermaking belt return rolls 19*c* and 19*d*, and also in between papermaking belt return rolls 19*d* and 19*e*, are belt cleaning showers 102 and 102*a*, respectively. The purpose of the belt cleaning showers 102 and 102*a* is to clean the papermaking belt 10 of any paper fibers, adhesives, strength additives, and the like, which remain attached to the section of the papermaking belt 10 in issue after the final step in the papermaking process. The loop that the papermaking belt 10 of the present invention travels around also includes a means for applying a fluid pressure differential to the paper web, which in the preferred embodiment of the present invention, comprises vacuum pickup shoe 24*a* and a vacuum box such as multi-slot vacuum box 24. Associated with the papermaking belt 10 of the present invention, and also not shown in FIG. 1 are various additional support rolls, return rolls, cleaning means, drive means, and the like commonly used in papermaking machines and all well known to those skilled in the art.

The embryonic web 18 is brought into contact with the papermaking belt 10 of the present invention by the Fourdrinier wire 15 when the Fourdrinier wire 15 is brought near the papermaking belt 10 of the present invention in the vicinity of vacuum pickup shoe 24*a*.

In conjunction with the third step, the process of the present invention, namely the continuous application of an effective amount of a chemical compound to the belt during the papermaking operation will be discussed. Although, it is to be understood that this process of applying chemical compounds to extend the belt life is independent of any particular step in the papermaking process; it is only discussed in conjunction with the third step for the sake of convenience. In fact, the chemical compounds can be applied to the papermaking belt at any point during the papermaking operation, although it is preferred that the chemicals be added to the paper contacting surface of the belt at a particular point in the belt's revolution wherein the belt is not carrying a paper web. This normally will be after the pre-dried paper web 27 has been transferred off the papermaking belt 10 to the surface of the Yankee dryer drum 28 and the belt has passed through cleaning showers 102 and 102*a*, but before the belt returns to contact another embryonic web 18 (e.g., in the vicinity of emulsion distribution roll 21).

As used herein, the term "effective amount of chemical compound" refers to an amount of the chemical compound which will slow down the rate at which the photosensitive polymeric resin degrades with time. That is, an effective amount of the chemical compound is the amount of the particular compound which will be capable of extending the useful life of the polymeric resin coated papermaking belt compared to a papermaking belt which is not treated with the chemical compound. Of course, the effective amount of the chemical compound will depend, to a large extent, on the particular compound used, and on the process conditions to which the papermaking belt is exposed.

As used herein, the term "continuous application" refers to the addition of the chemical compounds to the resin coated papermaking belt surface at a point(s) during each revolution of the belt. Preferably, the chemical compounds are applied uniformly to the upper belt surface so that substantially the entire paper-contacting surface of the belt benefits from the chemical treatment.

As used herein, the term "chemical compound" refers to any chemical that when continuously applied to the polymeric resin coated papermaking belt, will extend the belt's useful life. Examples of types of chemical compounds suitable for use in the process of the present invention include antioxidants (which will be discussed in detail below), reducing agents, chelating agents, preservatives, release agents, ultraviolet light stabilizers, and plasticizers. Reducing agents are chemical compounds that will oxidize more readily than vulnerable linkages in the polymeric resin (e.g., ether linkages). These include, for example, sulfite ions, mercaptans, and stannous chloride. Chelating agents are chemical compounds, such as EDTA, that complex oxidation catalysts (e.g., transition metals). Preservatives are chemical compounds that prevent or retard the growth of microorganism that can damage polymeric resins. These include, for example, fungicides and antimicrobials. Release agents are chemical compounds that modify the surface energy of the polymeric resin coated belt to keep debris from sticking to the belt surface and allow for efficient transfer of the web from the belt to the dryer. Examples of common release agents include oils (hydrocarbons or silicones), fluoroplastics, and waxes. Ultraviolet light stabilizers are chemical compounds such as 2-hydroxyphenylbenzotriazole, that protect the polymeric resin coated belts from photodegradation. Plasticizers are chemical compounds that improve the flexibility of the papermaking belts. These include, for example, glycerine, di-2-ethylhexyl phthalate, and dipropylene glycol dibenzoate. The above list of chemical compounds is for exemplary purposes only, and is not intended to be all-inclusive. Other types of chemical compounds, which are known to those skilled in the polymer or papermaking art to be capable of extending the life of polymeric resin coated papermaking belts are intended to be within the scope of this invention.

In the preferred embodiment of carrying out the present invention, the chemical compounds are selected from suitable antioxidants. As used herein, the term "antioxidants" refers to organic compounds that can be incorporated at low concentrations to inhibit or retard oxidation of the papermaking belt's cured resin framework and its ensuing degradative effects. Degradation is a sequential process involving an initiation, propagation, and termination phase. The formation of free radicals initiates polymeric oxidation. Factors contributing to free radical generation include the presence of reactive peroxides or ketones during polymerization as well as chemical/cellulosic debris which builds up on the belt surface during the papermaking operation. This, coupled with the thermal and mechanical stress experienced by the belt during the papermaking operation, ultimately ends up in the belt failing through oxidation. To protect against oxidation, the antioxidant concentration in the cured resin framework should be maintained at from about 0.001% to about 5.0% by weight (based on the weight of the resin framework) preferably from about 0.05% to about 1.5%. Of course, the optimum concentration will depend on the particular antioxidant used and on the process conditions to which the belt is exposed.

There are two types of antioxidants, namely primary antioxidants and secondary antioxidants. Primary antioxidants, such as hindered phenols and secondary amines, scavenge free radicals and interrupt oxidative chain reactions. Oxidation of polymeric resins frequently involves the formation of a hydroperoxide intermediate. When the metastable hydroperoxide decomposes, it can cleave the polymer backbone and produce more free radicals. Secondary antioxidants, such as phosphates, phosphites, or sulfur-containing compounds (like thioesters), and secondary sulfides, safely diffuse the hydroperoxide intermediates to stable byproducts (e.g., alcohols). This prevents the peroxides from decomposing into free radicals and oxidizing the polymeric resin. The combination of the two types of antioxidants can produce a synergistic effect.

The preferred antioxidant types for the present invention are the primary antioxidants, with the hindered phenols being most preferred. Hindered phenols scavenge free radicals through the transfer of the labile hydrogen from the hydroxyl group. Hindered phenolic antioxidants are available in a wide variety of molecular weights and prices. Higher-molecular weight hindered phenols usually provide greater long-term stability with correspondingly higher prices. Conversely, lower-molecular weight hindered phenols provide less long-term stability due to their higher volatility, although some of these lower-molecular weight antioxidants have the advantage of having FDA acceptance. Examples of commercially available, suitable hindered phenols for use in the present invention include: tetrakis [methylene (3,5-di-tert-butyl-4-hydroxyhydrocinnamate)] methane—Irganox 1010 marketed by Ciba Geigy, 2,6-di-t-butyl-4-methylphenol (BHT), 1,3,5-Tris(4-tert-butyl-3-hydroxy-2,6-dimethylbenzyl)-1,3,5-triazine-2,4,6-(1H,3H,5H)-trione—Cyanox 1790 marketed by the American Cyanamid Company, and 2.2'-Methylenebis (4-methyl-6-tert-butylphenol)—Cyanox 2246 also marketed by the American Cyanamid Company. Mixtures of hindered phenolic antioxidants may be used in the practice of the present invention. References containing more information about hindered phenolic antioxidants include: Johnson, "Antioxidants Syntheses and Applications", pp. 3-58 (1975) and Capolupo and Chucta, "Antioxidants", Modern Plastics Encyclopedia, pp. 127-128 (1988), both of which are incorporated herein by reference.

Another type of primary antioxidant which can be used in the practice of the present invention is the secondary amines. Secondary amines scavenge radicals via the transfer of a hydrogen from the —NH group and are superior to hindered phenols for high-temperature stabilization. However, amines tend to stain and discolor and can only be used where darker colors can be tolerated or masked. In addition, amines have limited FDA acceptance. One example of a secondary amine antioxidant is (4,4'-bis(a,a-dimethylbenzyl)-diphenylamine—Naugard 445 from Uniroyal, Inc. Secondary amines antioxidants are described in greater detail in Johnson, "Antioxidants Syntheses and Applications", pp. 60-79 (1975), incorporated herein by reference. Mixtures of secondary amines and hindered phenols may be used to protect the papermaking belt against oxidation.

Secondary antioxidants decompose peroxides to stable byproducts (e.g., alcohols). They are considered to be cost-effective because they can be substituted for a portion of the more costly primary antioxidant(s) and provide equivalent performance. One drawback, however, is their propensity toward hydrolysis. Preferred types of secondary antioxidants for use in the present invention are phosphites, thioesters and mixtures thereof. Examples of commercially available phosphites include Tris(mono-nonylphenyl) phosphite—Naugard P marketed by Uniroyal, Inc. and Tris(2,4-di-tert-butylphenyl) phosphite—Naugard 524 also marketed by Uniroyal, Inc. An example of a commercially available thioester is dilaurylthiodipropionate—Cyanox LDTP marketed by American Cyanamid. A more detailed description of secondary antioxidant compounds including phosphites and thioesters is set forth in Johnson, "Antioxidants Syntheses and Applications", pp. 106-147 (1975), incorporated by reference herein.

Combinations of primary antioxidants and secondary antioxidants are especially preferred for use herein. Most preferred, are combinations of hindered phenols and thioesters.

The chemical compounds (e.g., antioxidants) are preferably applied to the polymeric resin coated papermaking belt in an aqueous solution, emulsion, or suspension. The chemical compounds can also be applied in a solution containing a suitable, nonaqueous solvent in which the compounds are miscible; although an emulsion containing the chemical compounds is preferable for use in the practice of the present invention. Preferably, the chemical compounds are applied uniformly to the top side of the resin coated belts so that substantially the entire paper-contacting surface benefits from the chemical treatment.

Surprisingly, it has been found that the chemical compounds (e.g., antioxidants) are effective when applied to the papermaking belt during the papermaking operation. This is especially unexpected because the belts are travelling at high speeds, typically about 2500 rpm, which translates to one complete revolution every three seconds. In addition, in the preferred embodiment, the belts travel through belt cleaning showers 102 and 102*a* every revolution and over fluid removing vacuum boxes 24*a* and 24. Thus, the chemical compounds have a very short period of time (i.e., typically less than three seconds) to be absorbed by the resin or to form a protective surface coating and increase the belt's useful life.

Any application technique known in the art which evenly distributes the chemical compounds at the desired rate onto the papermaking belt 10 may be employed. These application techniques of continuously applying the chemical compounds to the belt include transfer roll coating, spraying and gravure printing. Transfer roll coating has been found to be economical and susceptible to accurate control over quantity and distribution of the compounds, so is most preferred. Any type of cylindrical distribution or coating roll commonly used in papermaking machines may be used. Equipment suitable for spraying chemical compounds onto papermaking belts include external mix, air atomizing nozzles, such as the 2 mm nozzle available from V.I.B. Systems, Inc., Tucker, Ga. Equipment suitable for printing solutions or emulsions containing dissolved chemical compounds onto the papermaking belts include Rotogravure Printers.

An especially preferred method of continuously applying chemical compounds to the papermaking belt is via an emulsion distributing roll 21 and emulsion bath 23, illustrated in FIG. 1. In this preferred method, the chemical compound is dissolved into at least one phase of an emulsion 22 comprised of three primary compounds, namely water, oil, and a surfactant, although it is contemplated that other or additional suitable compounds could be used. The emulsion 22 containing the dissolved chemical compounds (e.g., antioxidants) is applied to the papermaking belt 10 via the above-mentioned emulsion distributing roll 23. Emulsion 22 can also be applied to the papermaking belt 10 through cleaning showers 102 and 102*a*.

An example of an especially preferred emulsion composition contains water, a high-speed turbine oil known as "Regal Oil", dimethyl distearyl ammoniumchloride, cetyl alcohol, and a hindered phenol antioxidant known as "Cyanox 1790" marketed by American Cyanamid. As used herein, the term "Regal Oil" refers to the compound which is comprised of approximately 87% saturated hydrocarbons and approximately 12.6% aromatic hydrocarbons with traces of additives, manufactured as product number R&0 68 Code 702 by the Texaco Oil Company of Houston, Tex. The purpose of the Regal Oil in the composition described above is to serve as a "release emulsion." By "release emulsion," it is meant that it provides a coating on the papermaking belt 10 so the paper formed releases from (or does not stick to) the same after the steps of the present invention have been performed to the paper web.

Dimethyl distearyl ammoniumchloride is sold under the tradename AROSURF TA 100 by the Sherex Chemical Company, Inc., of Rolling Meadows, Ill. Hereinafter, dimethyl distearyl ammoniumchloride will be referred to as AROSURF for convenience. AROSURF is used in the emulsion as a surfactant to emulsify or stabilize the oil particles (e.g., Regal Oil) in the water. As referred to herein, the term "surfactant" refers to a surface active agent, one portion of which is hydrophilic, and another portion of which is hydrophobic, which migrates to the interface between a hydrophilic substance and a hydrophobic substance to stabilize the two substances.

As used herein, "cetyl alcohol" refers to a $C_{16}$ linear fatty alcohol. Cetyl alcohol is manufactured by The Procter & Gamble Company of Cincinnati, Oh. Cetyl alcohol, like AROSURF is used as a surfactant in the emulsion utilized in the preferred embodiment of the present invention.

The relative percentages of the composition of the emulsion, in the preferred embodiment of the same are set out in the following table:

| Component | Volume (gal.) | Weight (lbs.) |
|---|---|---|
| Water | 518 | 4,320.0 |
| REGAL OIL | 55 | 421.8 |
| AROSURF | N/A* | 24 |
| Cetyl Alcohol | N/A* | 16 |
| Cyanox 1790 | N/A* | 5.3 |

*N/A - Component is added in solid form.

Fourth Step

The fourth step in the papermaking process is deflecting the fibers in the embryonic web 18 into the conduits 36 of papermaking belt 10 and removing water from the embryonic web 18, as by the application of differential fluid pressure to the embryonic web, to form an intermediate web 25 of papermaking fibers. One preferred method of applying differential fluid pressure is by exposing the embryonic web 18 to a vacuum in such a way that the web is exposed to the vacuum through conduit 36 as by application of a vacuum to a papermaking belt 10 on the side designated bottom surface 12. In FIG. 1, this preferred method is illustrated by the use of vacuum pickup shoe 24*a* and the multi-slot vacuum box 24. Optionally, positive pressure in the form of air or steam pressure can be applied to embryonic web 18 in the vicinity of pickup shoe 24*a* or vacuum box 24 through Fourdrinier wire 15. Conventional means for this optional pressure application are not shown in FIG. 1.

Figure 1A:
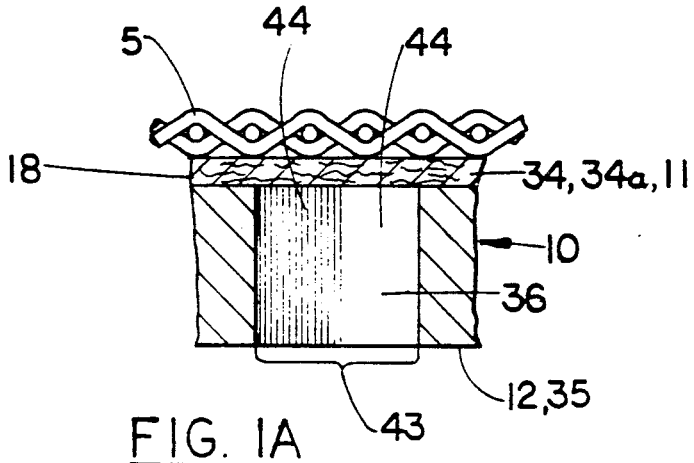
FIG. 1A is a simplified schematic representation of a cross-section which shows the partially-formed embryonic web of papermaking fibers prior to its deflection into a conduit of the papermaking belt.
Figure 1B:
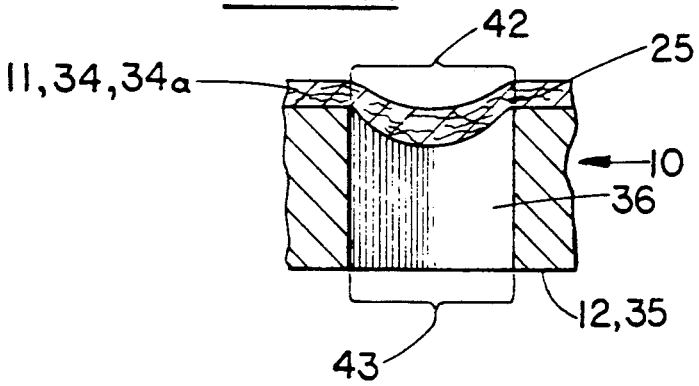
FIG. 1B is a simplified representation in cross-section of the portion of the embryonic web shown in FIG. 1A after the fibers of the embryonic web have been deflected into one of the conduits of the papermaking belt.

The deflection of the fibers into the conduits 36 is illustrated in FIGS. 1A and 1B. FIG. 1A is a simplified representation of a cross section of a portion of a papermaking belt 10 and embryonic web 18 after the embryonic web 18 has been associated with the papermaking belt 10, but before the deflection of the fibers into conduits 36 by the application of a differential fluid pressure. As seen in FIG. 1A, the embryonic web 18 is still in contact with the Fourdrinier wire 15. In FIG. 1A, only one conduit 36 is shown; the embryonic web 18 is associated with the first side network surface 34*a* of the papermaking belt 10. The first side network surface 34*a* will be described in greater detail in the section of this specification dealing with the papermaking belt.

FIG. 1B, as FIG. 1A, is a simplified cross sectional view of a portion of the papermaking belt 10. This view, however, illustrates the embryonic web 18 after its fibers have been deflected into the conduit 36 by the application of a differential fluid pressure. It is to be observed that a substantial portion of the fibers in embryonic web 18 and, thus, embryonic web 18 itself, has been displaced below the first side network surface 34*a* and into conduit 36 to form intermediate web 25. Rearrangement of the fibers in embryonic web 18 (not shown) occurs during deflection and water is removed through conduit 36 as discussed more fully hereinafter.

It must be noted that either at the time the fibers are deflected into the conduits or after such deflection, water removal from the embryonic web 18 and through the conduits begins. Water removal occurs, for example, under the action of differential fluid pressure. It is important, however, that there be essentially no water removal from the embryonic web 18 prior to the deflection of the fibers into the conduits 36. As an aid in achieving this condition, the conduits 36 are relatively isolated one from another. This isolation, or compartmentalization, of conduits 36 is of importance to insure that the force causing the deflection, such as an applied vacuum, is applied relatively suddenly and in sufficient amount to cause deflection of the fibers.

In the machine illustrated in FIG. 1, water removal initially occurs at the pickup shoe 24*a* and vacuum box 24. Since the conduits are open through the thickness of papermaking belt 10, water withdrawn from the embryonic web 18 passes through the conduits and out of the system as, for example, under the influence of the vacuum applied to the bottom surface of papermaking belt 10. Water removal continues until the consistency of the web associated with conduit 36 is increased to from about 20% to about 35%.

Following the application of vacuum pressure, the embryonic web 18 is in a state in which it has been subjected to the vacuum pressure but not fully dewatered, thus it is now referred to as the "intermediate web 25".

Fifth Step

The fifth step in the papermaking process is the drying of the intermediate web 25 to form the paper web of this invention. Any convenient means conventionally known in the papermaking art can be used to dry the intermediate web 25. For example, blow-through dryers and Yankee dryers, alone and in combination, are satisfactory.

A preferred method of drying the intermediate web 25 is illustrated in FIG. 1. After leaving the vicinity of vacuum box 24, intermediate web 25, which is associated with the papermaking belt 10, passes around the papermaking belt 10 return roll 19*a* and travels in the direction indicated by directional arrow B. Intermediate web 25 first passes through optional predryer 26. This predryer 26 can be a conventional blow-through dryer (hot air dryer) well known to those skilled in the art.

The quantity of water removed in predryer 26 is controlled so that predried web 27 exiting predryer 26 has a consistency of from about 30% to about 98%. Predried web 27, which is still associated with papermaking belt 10, passes around papermaking belt 10 return roll 19*b* and travels to the region of impression nip roll 20.

As predried web 27 passes through the nip formed between impression nip roll 20 and Yankee dryer drum 28, the network pattern formed on the top surface plane of the papermaking belt 10 (which will hereinafter be described in greater detail) is impressed into predried web 27 to form imprinted web 29. Imprinted web 29 is then adhered to the surface of Yankee dryer drum 28 where it is dried to a consistency of at least about 95%.

The section of the belt 10 which has been carrying the web passes around papermaking belt 10 return rolls 19*c*, 19*d*, 19*e*, and 19*f* and through cleaning showers 102 and 102*a* located therebetween where it is cleaned. From the showers, the section of the belt moves on to the emulsion roll 21 where it receives another application of emulsion 22 prior to contacting another embryonic web 18.

Sixth Step

The sixth step in the papermaking process is the foreshortening of the dried web (imprinted web 29). This sixth step is an optional, but highly preferred, step.

As used herein, foreshortening refers to the reduction in length of a dry paper web which occurs when energy is applied to the dry web in such a way that the length of the web is reduced and the fibers in the web are rearranged with an accompanying disruption of fiber-fiber bonds. Foreshortening can be accomplished in any of several well-known ways. The most common, and preferred, method is creping.

In the creping operation, the dried web 29 is adhered to a surface and then removed from that surface with a doctor blade 30. Usually, the surface to which the web is adhered also functions as a drying surface and is typically the surface of a Yankee dryer. Such an arrangement is illustrated in FIG. 1.

The adherence of imprinted web 29 to the surface of Yankee dryer drum 28 is facilitated by the use of a creping adhesive. Typical creping adhesives include those based on polyvinyl alcohol. Specific examples of suitable adhesives are shown in U.S. Pat. No. 3,926,716 issued to Bates on Dec. 16, 1975, incorporated by reference herein. The adhesive is applied to either predried web 27 immediately prior to its passage through the hereinbefore described nip or more preferably, to the surface of Yankee dryer drum 28 prior to the point at which the web is pressed against the surface of Yankee dryer drum 28 by impression nip roll 20. (Neither means of glue application is indicated in FIG. 1; any technique, such as spraying, well-known to those skilled in the art an be used.) In general, only the nondeflected portions of the web which have been associated with top surface plane 11 of the papermaking belt 10 are directly adhered to the surface of Yankee dryer drum 28. The paper web adhered to the surface of Yankee drum 28 and dried to at least about 95% consistency, is removed (i.e., creped) from the surface by doctor blade 30. Energy is thus applied to the web and the web is foreshortened. The exact pattern of the network surface and its orientation relative to the doctor blade 30 will in major part dictate the extent and the character of the creping imparted to the web.

Paper web 31, which is the product of this process, can be optionally calendered and is either rewound (with or without differential speed rewinding) or is cut and stacked all by means not illustrated in FIG. 1. Paper web 31 is then ready for use.

2. The Improved Paper

The improved paper web, which is sometimes known to the trade as a tissue paper web, is made by the process described above. As seen is FIGS. 1C and 1D, the improved paper web 31 is characterized as having two distinct regions.

The first is a network region 100 which is continuous, and which forms a preselected pattern. It is called a "network region" because it comprises a system of lines of essentially uniform physical characteristics which intersect, interlace, and cross like the fabric of a net. It is described as "continuous" because the lines of the network region are essentially uninterrupted across the surface of the web. (Naturally, because of its very nature paper is never completely uniform, e.g., on a microscopic scale. The lines of essentially uniform characteristics are uniform in a practical sense and, likewise, uninterrupted in a practical sense.) The network region is described as forming a preselected pattern because the lines define (or outline) a specific shape (or shapes) in a repeating (as opposed to random) pattern.

Figure 1C:
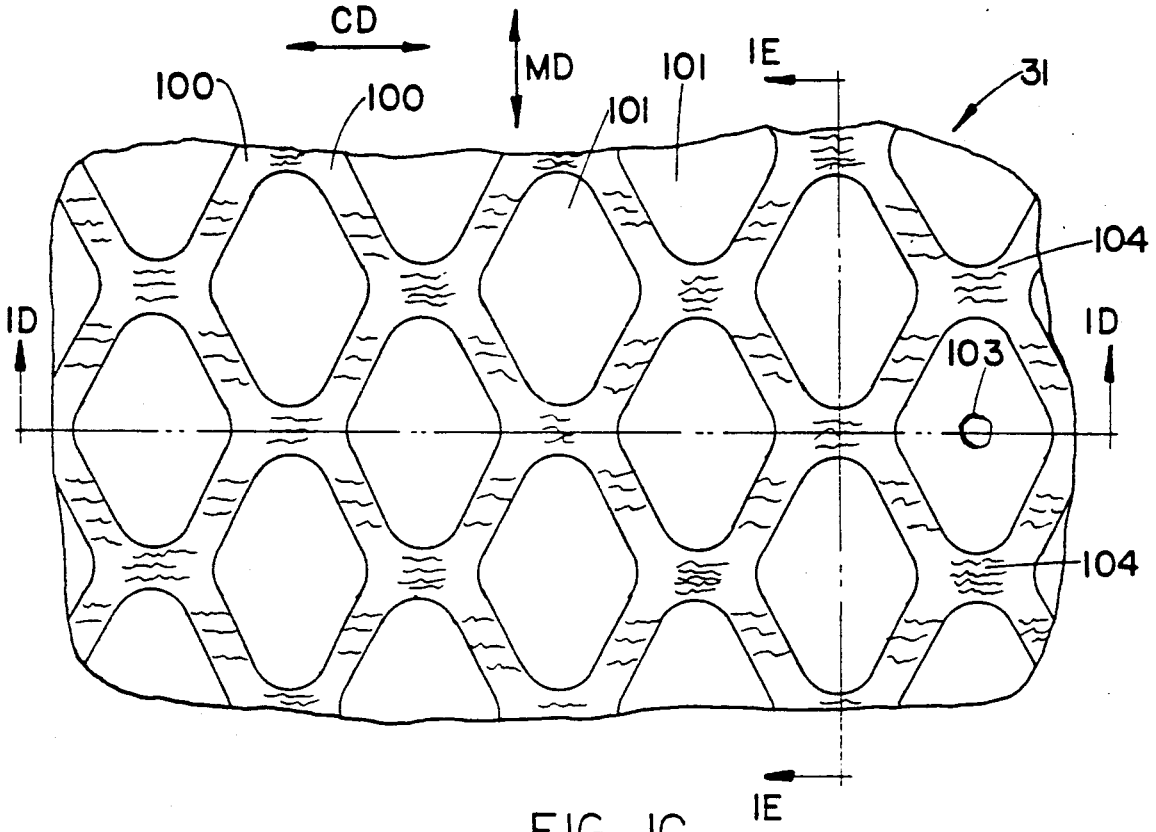
FIG. 1C is a simplified plan view of a portion of a paper web made by the process of the present invention.

FIG. 1C illustrates in plan view a portion of an improved paper web 31. The network region 100 is illustrated as defining modified diamonds, although it is to be understood that other preselected patterns are useful in this invention. FIG. ID is a cross sectional view of paper web 31 taken along line ID—ID of FIG. 1C.

Figure 1D:
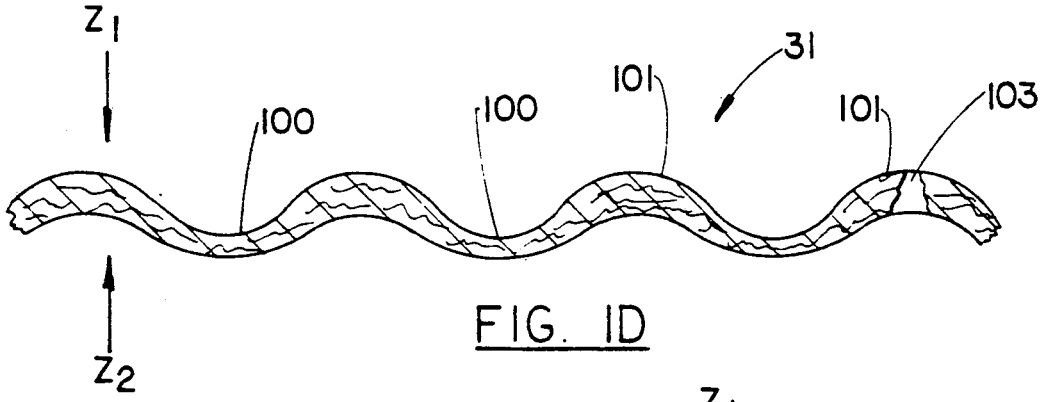
FIG. 1D is a machine-direction sectional view of the portion of the paper web shown in FIG. 1C as taken along line 1D—1D.

The second region of the improved tissue paper web comprises a plurality of domes 101 dispersed throughout the whole of the network region 100. As can be seen from FIG. 1C, the domes are dispersed throughout network region 100 and essentially each is encircled by network region 100. The shape of the domes (in the plane of the paper web) is defined by the network region 100. FIG. 1D illustrates the reason the second region of the paper web is denominated as a plurality of "domes". Domes 101 appear to extend from (protrude from) the plane formed by network region 100 toward an imaginary observer looking in the direction of arrow $Z_1$. When viewed by an imaginary observer looking in the direction indicated by arrow $Z_2$ in FIG. 1D, the second region comprises arcuate-shaped cavities or dimples. The second region of the paper web has thus been denominated a plurality of "domes" for convenience.

Figure 1E:
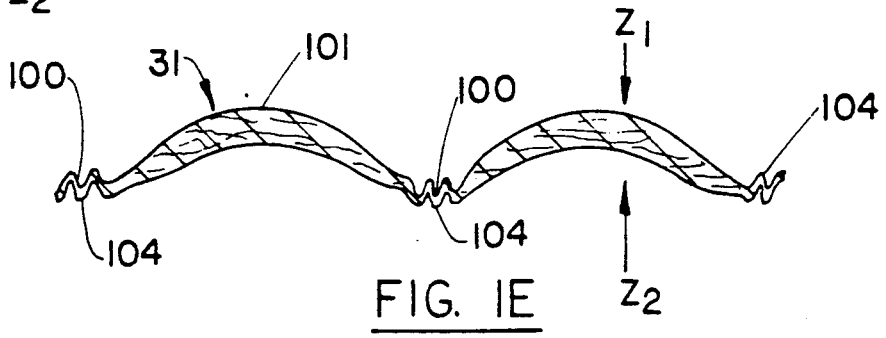
FIG. 1E is a cross-machine direction sectional view of the portion of the paper web shown in FIG. 1C as taken along line 1E—1E.

FIG. 1E is a cross sectional view of the paper web 31 taken along lines 1E—1E of FIG. 1C (a machine direction sectional). FIG. 1E illustrates the ridges 104 formed in the paper web 31 by the creping process. The paper structure forming the domes 101 can be intact; or as seen in FIG. 1D, it can also be provided with one or more holes or openings, such as hole 103, extending essentially through the structure of the paper web 31.

In one embodiment of the improved paper, the basis weight of the domes 101 and the network region 100 are essentially equal, but the density (weight per unit volume) of the network region 100 is high relative to the density of the domes 101.

In a second embodiment, the improved paper has a relatively low network region 100 basis weight compared to the basis weights of the domes 101. That is to say, the weight of fiber in any given area projected onto the plane of the paper web 31 of the network region 100 is less than the weight of fiber in an equivalent projected area taken in the domes 101. Further, the density (weight per unit volume) of the network region 100 is high relative to the density of the domes 101.

Preferred paper webs of this invention have an apparatus (or bulk or gross) density of from about 0.020 to about 0.150 grams per cubic centimeter, most preferably from about 0.040 to about 0.100 g/cc. The density of the network region 100 is preferably from about 0.200 to about 0.800 g/cc, most preferably from about 0.500 to about 0.600 g/cc. The average density of the domes 101 is preferably from about 0.040 to about 0.150 g/cc, most preferably from about 0.060 to about 0.100 g/cc. The overall preferred basis weight of the paper web is from about 9 to about 95 grams per square meter. Considering the number of fibers underlying a unit area projected onto the portion of the web under consideration, the ratio of the basis weight of the network region to the average basis weight of the domes is from about 0.8 to about 1.0.

The paper web of this invention can be used in any application where soft, absorbent tissue paper webs are required. One particularly advantageous use of the paper web of this invention is in paper towel products. For example, two paper webs of this invention can be adhesively secured together in face to face relation as taught by U.S. Pat. No. 3,414,459, which issued to Wells on Dec. 3, 1968, and which is incorporated herein by reference, to form 2-ply paper towels.

3. The Papermaking Belt

As set forth above, it is desired to produce an improved paper with the aforementioned desired characteristics. In order to produce such a paper, it is necessary to utilize in the papermaking process a papermaking belt 10 having certain qualities which will transfer the desired characteristics to the paper web. Desirable qualities of the papermaking belt 10 are described below.

A detailed description of a papermaking belt without the improvements disclosed herein is set forth in U.S. Pat. No. 4,528,239, entitled "Deflection Member" which issued to Paul D. Trokhan on July 9, 1985, which is incorporated by reference herein, although other structures may also be used to make the improved paper. Reference is made in particular to column 6, lines 20, to column 10, line 60, inclusive, of the Trokhan patent for an extensive discussion of the prior papermaking belt.

As noted above, in the embodiment illustrated in FIG. 1, the papermaking belt takes the form of an endless belt, papermaking belt 10. Although the preferred embodiment of the papermaking belt 10 used in the present invention is in the form of an endless belt, the present invention can be incorporated into numerous other forms which include, for instance, stationary plates for use in making handsheets or rotating drums for use with other types of continuous processes. Regardless of the physical form which the papermaking belt 10 takes, it generally has certain physical characteristics.

The papermaking belt 10 generally has two opposed surfaces which will be referred to herein as the paper-contacting surface 11 and the machine-contacting surface 12. The paper-contacting surface 11 is also referred to herein and in the references incorporated herein as the "upper surface", the "top surface", the "working surface", the "embryonic web-contacting surface", the "paperside", or the "frontside", because it is the surface of the papermaking belt 10 which contacts the paper web which is to be dewatered and rearranged. The opposed surface, (i.e., the machine-contacting surface 12), is also referred to herein and in the patents incorporated herein by reference as the "lower surface", the "bottom surface", the "machine-contacting side", or simply the "back side" of the papermaking belt 10 because it is the surface which travels over and is in contact with the papermaking machinery such as the papermaking belt return rolls **19*a*, 19*b*, 19*c*** and vacuum box 24 employed in the papermaking process. It is to be understood that although the paper-contacting surface of the papermaking belt is sometimes referred to as the top surface of the belt, the orientation of the paper-contacting surface may be such that it is facing downwardly on the return path in the papermaking machine since it is in the configuration of an endless belt. Likewise, it is to be understood that although the machine-contacting surface of the papermaking belt is sometimes referred to as the bottom surface of the belt, the orientation of the machine-contacting surface may be such that it is facing upward on the return path in the papermaking machine.

Figure 4:
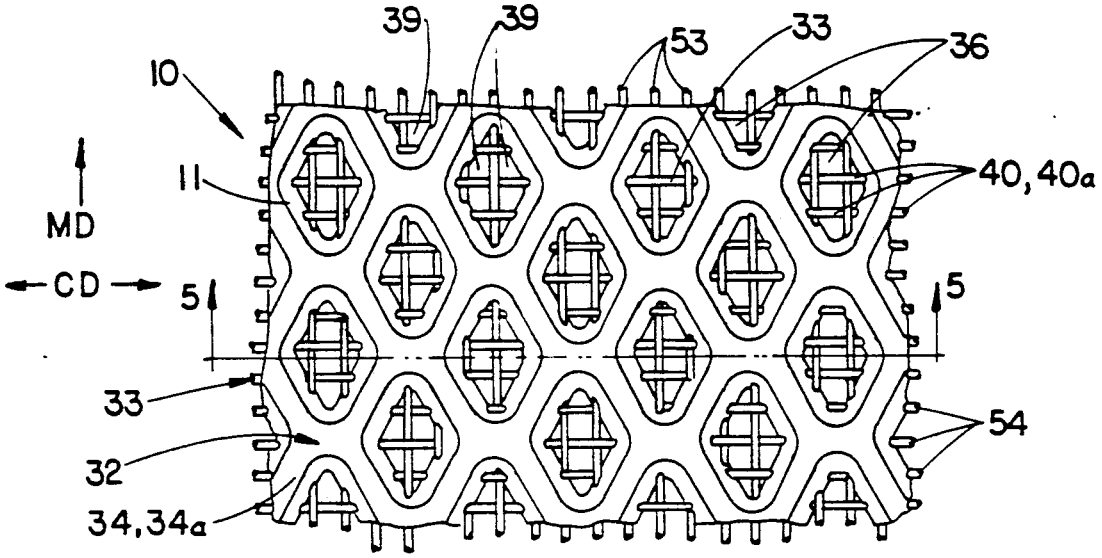
FIG. 4 is a plan view of one completely-assembled embodiment of the papermaking belt.

The papermaking belt 10 is generally comprised of two primary elements: a solid polymeric resin framework 32 and a reinforcing structure 33, both of which are first seen together in FIG. 4. The resin framework 32 has a first surface 34 for contacting the fiber webs to be dewatered, a second surface 35 opposite the first surface 34 for contacting the dewatering machinery employed in the dewatering operation (such as vacuum box 24 and papermaking belt return rolls 19*a*, 19*b*, 19*c*), and conduits 36 extending between the first surface 34 and the second surface 35 for channeling water from the fiber webs which rest on the first surface 34 to the second surface 35 and to provide areas into which the fibers of the fiber web can be deflected and rearranged. The reinforcing structure 33 is positioned between the first surface 34 of the framework 32 and at least a portion of the second surface 35 of the framework 32 of the papermaking belt 10.

In the preferred embodiment, the reinforcing structure 33 has interstices 39 therein. The portions of the reinforcing structure 33 exclusive of the interstices 39 (i.e., the solid portion) are referred to herein as a reinforcing structure component 40, or simply as a reinforcing component. The reinforcing structure has a projected open area defined by the projection of the areas defined by the interstices, and a projected reinforcing component area defined by the projection of the reinforcing component.

In addition, in the preferred embodiment, the second surface 35 of the framework 32 of the papermaking belt 10 has passageways 37 therein which provide surface texture irregularities, generally designated 38, (first seen in FIG. 5) which are distinct from the conduits 36. The passageways provide an uneven surface which allows vacuum pressure from the dewatering equipment, such as vacuum box 24, to at least partially escape across the machine-contacting side 12 of the papermaking belt 10. The surface texture irregularities 38 provide an uneven surface for contacting the machinery employed in the papermaking operation.

The first surface 34 of the framework 32 and the paper-contacting surface of the papermaking belt 10 are generally one and the same elements. This will usually be the case in most embodiments of the present invention since the reinforcing structure 33 is positioned between the first surface of the framework 34 and at least a portion of the second surface 35 of the framework 32 (that is, the first surface of the framework 32 generally covers one side of the reinforcing structure 33. The second surface 35 of the framework 32 of the papermaking fabric 10 and the machine-contacting surface 12 of the papermaking belt 10, however, are not necessarily one and the same elements. As noted above, the reinforcing structure 33 is between the first surface 34 and at least a portion of the second surface 35 of the framework 32. Thus, the second surface 35 can either completely cover the reinforcing structure 33, or only a portion of the second surface 35 will cover the reinforcing structure 33. In the former case, the second surface 35 of the framework 32 and the machine-contacting surface 12 of the papermaking belt 10 will be the same. In the latter case, the machine-contacting surface 12 of the papermaking belt 10 will be comprised partially of the second surface 35 of the framework 32 and partially of the exposed portion of the reinforcing structure 33.

Figure 2:
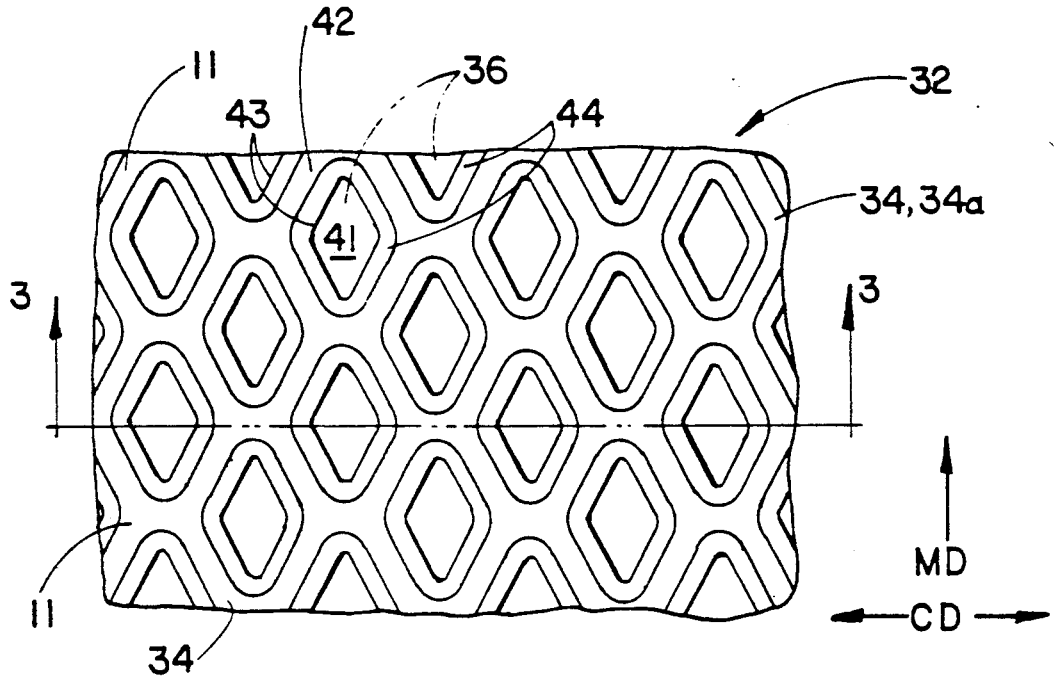
FIG. 2 is a plan view of a portion of the papermaking belt shown without the reinforcing structure.

In the following description, the characteristics of the framework 32 of the papermaking belt 10 and the conduits 36 which pass through the framework 32 will be examined first, and then the characteristics of the reinforcing structure 33 and alternative variations of the reinforcing structure 33 will be examined. The overall characteristics of the framework, and particularly the first surface of the same 34, are best seen in FIG. 2. In FIG. 2, it is first noted that in papermaking, directions are normally stated relative to machine direction (MD) or cross-machine direction (CD). Machine direction refers to that direction which is parallel to the flow of the paper web through the equipment. Cross-machine direction is perpendicular to the machine direction. These directions are indicated by arrows in FIG. 2 and in several of the other drawing figures.

FIG. 2 is a plan view of the first surface 34 of the resin framework 32 as seen without the reinforcing structure 33 in order to simplify the discussion of the characteristics of the resin framework 32. Although a papermaking belt can be created without such a reinforcing structure, the most practical papermaking belt for use in the papermaking process of the present invention incorporates some type of reinforcing structure for stability. As will be discussed in more detail hereinafter, the preferred material for use in forming the resin framework 32 is a liquid photosensitive resin which can be rendered solid by exposing it to a light of an activating wavelength (e.g., UV light). By controlling the exposure of the photosensitive resin to the light of an activating wavelength, the resulting solid polymeric resin framework properties can be manipulated.

The portion of the framework 32 which is exposed on the top surface of the papermaking belt 10 and which comprises the solid portion of the first surface 34 of the framework 32 resembles a net in appearance and will be referred to as the "top side network surface". The portion of the framework 32 which is exposed on the back side of the papermaking belt 10 on the other hand, will be referred to as the "backside network surface". As seen in FIGS. 2 and 4, the top side network surface 34*a* is macroscopically monoplanar, patterned, and continuous. The definitions of the terms used above to describe the top side network surface (i.e., "macroscopically monoplanar, patterned, and continuous") are the same as those contained in U.S. Pat. Nos. 4,514,345, 4,528,239, 4,529,480, and 4,637,859 incorporated by reference herein. Therefore, by "macroscopically monoplanar", it is meant that when a portion of the paper-contacting side of the papermaking belt 10 is placed into a planar configuration, the network surface is essentially in one plane. It is said to be "essentially" monoplanar to recognize the fact that deviations from absolute planarity are tolerable, but not preferred, so long as the deviations are not substantial enough to adversely affect the performance of the product formed on the papermaking belt. The network surface is said to be "continuous" because the lines formed by the network surface must form at least one essentially unbroken net-like pattern. The pattern is said to be "essentially" continuous to recognize the fact that interruptions in the pattern are tolerable, but not preferred, so long as the interruptions are not substantial enough to adversely affect the performance of the product made on the papermaking belt.

In the representation shown in FIG. 2, it is seen that the paper-contacting surface 11 of the papermaking belt 10 contains a plurality of conduits 36 therein which pass through the framework 32 to the second surface 35. Each conduit 36 defines certain features, which include: a channel portion or a hole, generally designated 41; a mouth, or conduit opening, such as first conduit opening 42 formed along the first surface 34 of the framework 32; a mouth, or conduit opening, such as second conduit opening 43 formed along the second surface 35 of the framework 32; and, conduit walls, generally designated 44, which define the dimensions of the conduits in the interior portion of the framework (i.e., the portion which lies between the first surface 34 and the second surface 35).

While the openings of the conduits 36 can be of random shape and in random distribution, they preferably are uniform shape and are distributed in a repeating, preselected pattern. Practical shapes includes circles, ovals, and polygons of six or fewer sides. There is no requirement that the openings of the conduits be regular polygons or that the sides of the openings be straight; openings with curved sides, such as trilobal figures, can be used. Although there are an infinite variety of possible geometries for the network surface and the openings of the conduits, certain broad guidelines for selecting a particular geometry can be stated. Without being bound by theory, it is believed that regularly shaped and regularly organized conduits are important in controlling the physical properties of the final paper web. The more random the organization and the more complex the geometry of the conduits, the greater is their effect on the appearance attributes of a web. The maximum possible staggering of the conduits tends to produce isotropic paper webs (that is, paper webs which exhibit properties with the same values when measured along all axes in all directions). If anisotropic paper webs are desired, the degree of staggering of the conduits should be reduced.

The shape and arrangement of the conduits 36 shown in FIG. 2 are in an especially preferred form. The shape and arrangement of the conduit openings depicted in FIG. 2 is referred to herein as a "linear Idaho" pattern. In particular, the preferred shape and arrangement of conduit openings is designated herein as a "300 linear Idaho with 35% knuckle area" pattern. The first number of the above designation represents the number of conduits per square inch present in the framework. The second member (i.e., 35% knuckle area) refers to the projected area of the topside network surface. The name "linear Idaho" is based on the fact that the cross-section of conduits from which this pattern was derived, originally resembled the shape of a potato. The walls of the conduits on four sides, however, are formed by generally straight lines, thus the pattern is referred to as being a "linear" Idaho rather than simply as an Idaho pattern. As seen in FIG. 2, the shape of the conduits are roughly in the form of modified parallelograms in cross-section. The shape of the conduits is described as resembling modified parallelograms because in this plan view, each conduit has four sides, in which each pair of opposite sides are parallel, the angle between adjacent sides are not right angles, and the corners formed between adjacent sides are rounded.

Figure 6:
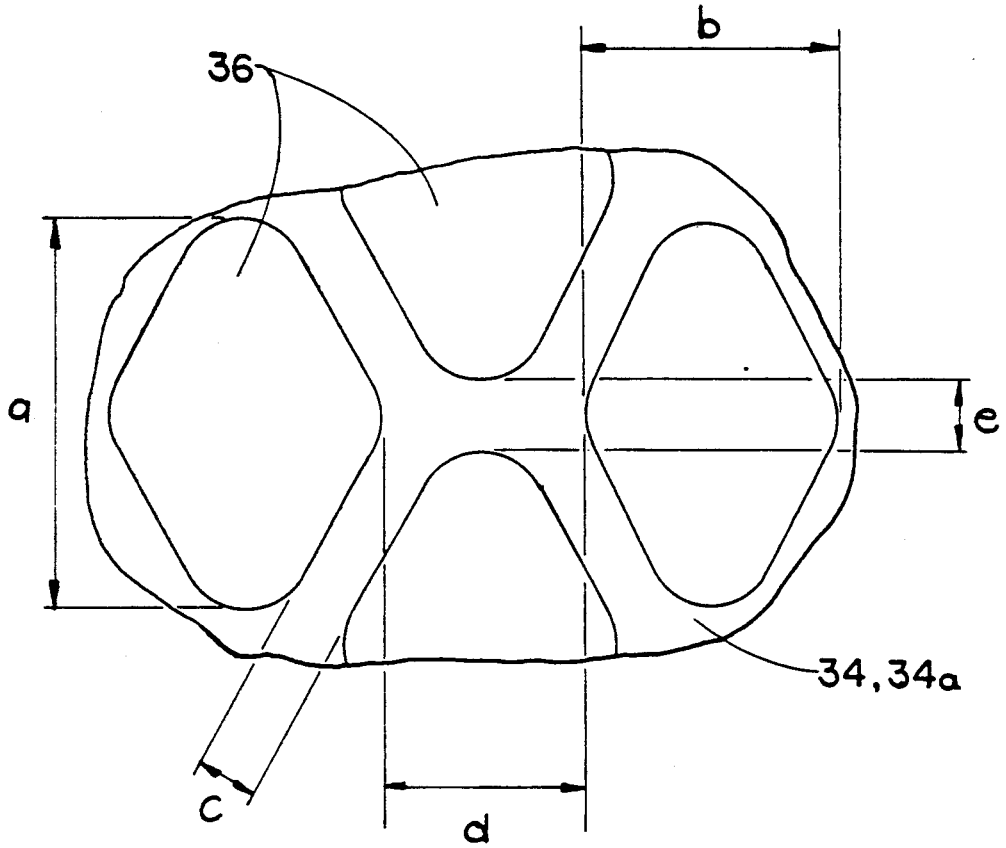
FIG. 6 is an enlarged schematic representation of one preferred conduit opening geometry.
Figure 7:
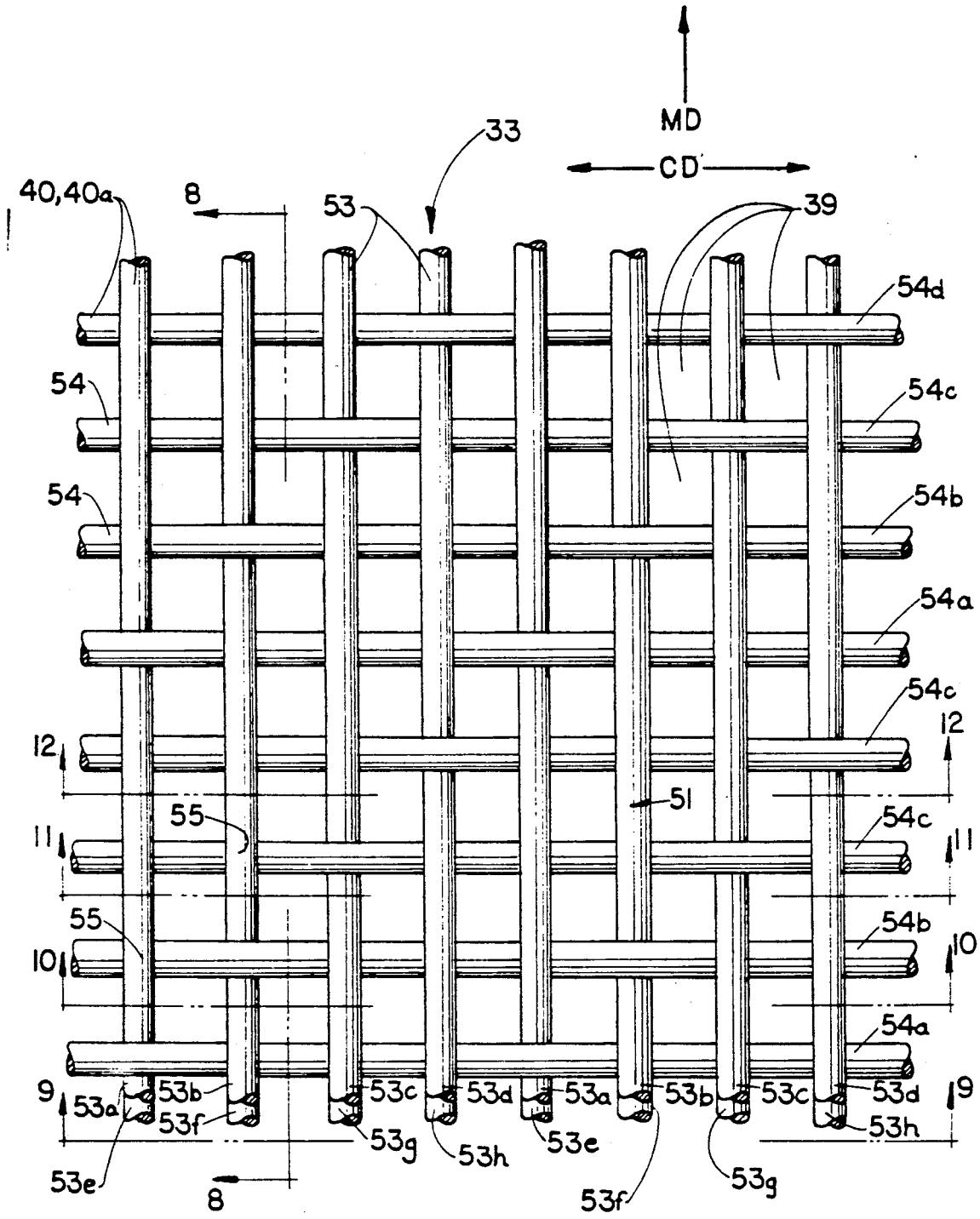
FIG. 7 is a plan view illustrating one preferred woven multilayered reinforcing structure which can be used in the papermaking belt.

The relevant dimensions of this pattern are best seen in FIG. 6. In FIG. 6, reference letter "a" represents the machine direction (MD) length, or simply the "length" of an opening as illustrated, "b" the length of the opening as measured in the cross-machine direction (CD), or the "width" of the opening, "c" the spacing between two adjacent openings in a direction intermediate MD and CD, "d" the CD spacing between adjacent openings, and "e" the MD spacing between adjacent opening. In an especially preferred embodiment, for use with northern softwood Kraft furnishes, "a" is 1.6892 mm, "" is 1.2379 mm, "c" is 0.28153 mm, "d" is 0.92055 mm, and "e" is 0.30500 mm. A papermaking belt 10 constructed to this geometry has a topside network open area of about 65%. These dimensions can be varied proportionally for use with other furnishes.

Figure 3:
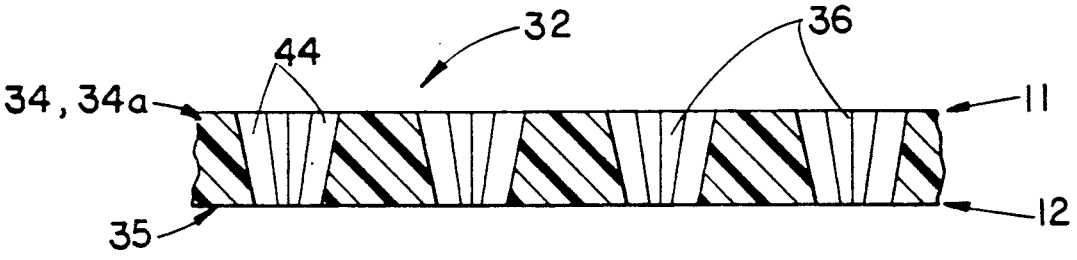
FIG. 3 is a cross-sectional view of the portion of the papermaking belt shown in FIG. 2 as taken along lines 3—3.

Referring back to FIG. 2, and additionally to FIG. 3, it is seen that the walls 44 forming the inside of the conduits are tapered inwardly from the top surface 34 of the framework 32 to the bottom surface 35. The tapering of the walls is controlled (as will be seen in the portion of this specification which deals with the process for making the papermaking belt 10) by collimating the light used to cure the photosensitive resin. Ideally, the walls are tapered so the surface area of the network is approximately 35% of the total projected surface area of the top surface of the papermaking belt and 65% of the total projected surface area (prior to backside texturing as will be further described herein) of the bottom surface of the papermaking belt 10. The reason the walls of the conduits are tapered to provide such a 35/65 ratio, is that a larger amount of resin is needed in the region near the backside of the papermaking belt 10 in order to mechanically bond the same sufficiently to the reinforcing structure 33. As seen in the figures, and as will be discussed more fully below, in the preferred embodiment of the invention, the reinforcing structure is located closer to the backside, rather than the topside of the papermaking belt. One reason the reinforcing structure 33 is more near the backside of the papermaking belt 10 is that the portion of the resin network which lies over the reinforcing structure 33 (hereinafter "the overburden"), is needed to form the conduits of the desired pattern and depth so the same may adequately serve their purpose of providing an area into which the fibers in the paper web can deflect in order that the same can be rearranged.

When it is said that the reinforcing structure 33 is located closer to the backside of the papermaking belt, the particular dimensions involved can vary. In the preferred embodiment of the papermaking belt 10, the typical woven element with stacked warp strands has a thickness of between 10 and 37 mils. The thickness of the resin overburden (i.e., the portion of the resin network which lies above the level of the top of the reinforcing structure) is typically between 1 and 30 mils. This forms a papermaking belt 10 between approximately 11 and 67 mils thick.

The openings or channels formed by the conduits extend through the entire thickness of the papermaking belt 10 and provide the necessary continuous passages connecting its two surfaces as mentioned above. As illustrated in FIGS. 2 through 5, conduits 36 are shown to be discrete, except at the bottom (as will be hereinafter discussed) where backside texturing is present. That is, they have a finite shape that depends on the pattern selected for the network formed in the framework and are separated one from another. Stated in still other words, the conduits are discretely perimetrically enclosed by the network surface. This separation is particularly evident in the plan view (FIG. 2). They are also shown to be isolated in that there is no connection within the body of the papermaking belt 10 between one conduit and another. This isolation one from another is particularly evident in the cross-sectional view (FIG. 3). Thus, transfer of material (e.g., water being removed from the paper web) from one conduit to another is not possible unless the transfer is effected outside the body of the papermaking fabric, or as will be hereinafter seen, along the backside of the papermaking belt.

Figure 5:
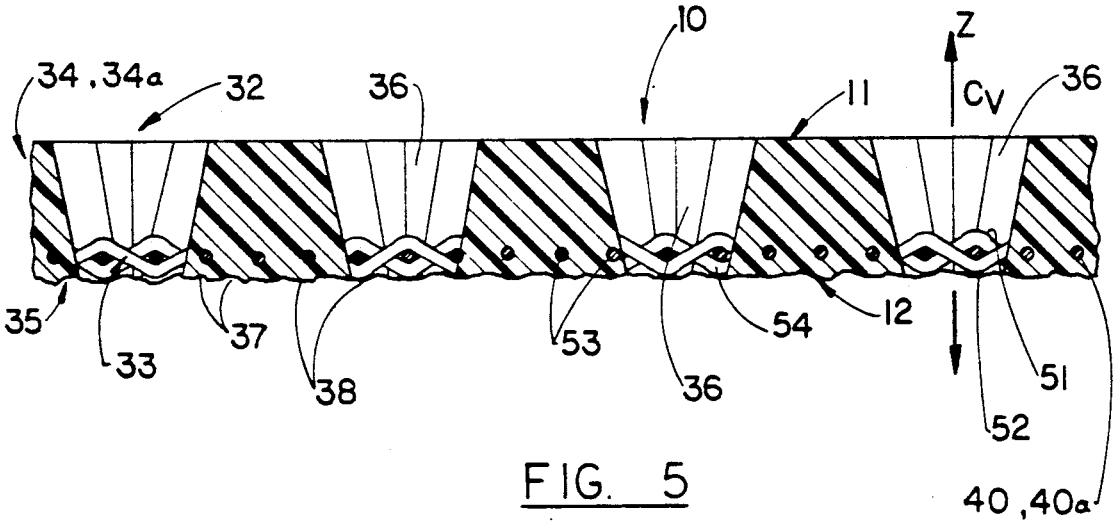
FIG. 5 is a cross-sectional view of the embodiment of the papermaking belt shown in FIG. 4 as taken along line 5—5 in which the backside surface is provided with texture of a positive character.

FIGS. 4 and 5 are analogous to FIGS. 2 and 3, but illustrate the more practical, and preferred, papermaking belt 10 which includes reinforcing structure 33 to strengthen the framework 32. FIG. 4 illustrates in plan view a portion of papermaking belt 10. FIG. 5 illustrates a cross-sectional view of that portion of papermaking belt 10 shown in FIG. 4 as taken along line 5—5. The reinforcing structure 33 is shown in FIGS. 4 and 5 as a monofilament woven element for purposes of simplification in illustrating the same. Although the present invention can be practiced using a monofilament woven element as the reinforcing structure 33, a multilayer woven element (more than one set of strands running in either the machine direction or the cross-machine direction) is preferred. FIGS. 4 and 5 generally illustrate that when the reinforcing structure comprises a woven element, the structural components 40*a* comprise machine direction warp reinforcing strands, generally designated 53, and cross-machine direction weft reinforcing strands, generally designated 54. As shown, reinforcing strands 53 and 54 are round and are provided as a square weave belt around which the framework 32 has been constructed. Any convenient filament size and shape in any convenient weave can be used as long as flow through the conduits is not significantly hampered during web processing and so long as the integrity of the papermaking belt 10 as a whole is maintained. While the material of construction of the filament is not critical; polyester is preferred. Other suitable materials from which the filaments can be constructed include polypropylene, nylon, and any other materials which are known for use in papermaking fabrics.

While in the preferred embodiment of the invention shown, the structure is a foraminous woven element, the structure can take a number of different forms. It can be a nonwoven element, a band, or plate (made of metal or plastic) with a series of holes punched or drilled in it, provided it is capable of adequately reinforcing the resin framework and provided it has suitable projected open area to allow the vacuum dewatering machinery to adequately perform its purpose, and provided it permits water removed from the paper web to pass through its interstices.

In describing the characteristics of the foraminous woven element shown in FIGS. 4 and 5, several terms of art were used. It is seen that the structural components 40*a* of the reinforcing structure 33 will generally be referred to as yarns, strands, filaments, fibers, or threads, when the reinforcing structure 33 comprises a woven element. It is to be understood that the terms yarns, strands, filaments, fibers and threads are synonymous. In addition, some of the yarns which comprise the reinforcing structure 33 have been referred to as warps 53 and others have been referred to as wefts 54. As used herein, the term "warp" will refer to yarns which are generally oriented in the machine direction when the papermaking belt 10 is installed in a papermaking machine. As used herein, the term "weft" will refer to yarns which are generally oriented in the cross-machine direction when the papermaking belt is installed in a papermaking machine.

As mentioned above, while a monofilament woven element can be used as the reinforcing structure 33 in the practice of the present invention, a multilayer woven element is preferred. Most preferred are those multilayer fabrics which have multiple warp, or machine direction strands because, as a result of the repeated travel of the papermaking belt over the rollers in the machine direction, the belt comes under considerable stress in the machine direction due to the endless travel and the heat transferred by the drying mechanisms employed in the papermaking process. Such heat and stress gives the papermaking belt 10 a tendency to stretch. If the papermaking belt 10 should stretch out of shape, its ability to serve its intended function becomes diminished to the point of uselessness.

The preferred reinforcing structure 33 is a multilayer woven belt characterized by warp strands which are generally vertically stacked directly on top of one another. The vertically-stacked warp yarns provide increased stability for the belt in the machine or process direction, while at the same time, do not decrease the projected open area of the belt needed to allow the same to be used in blow through drying papermaking processes.

Figure 8:
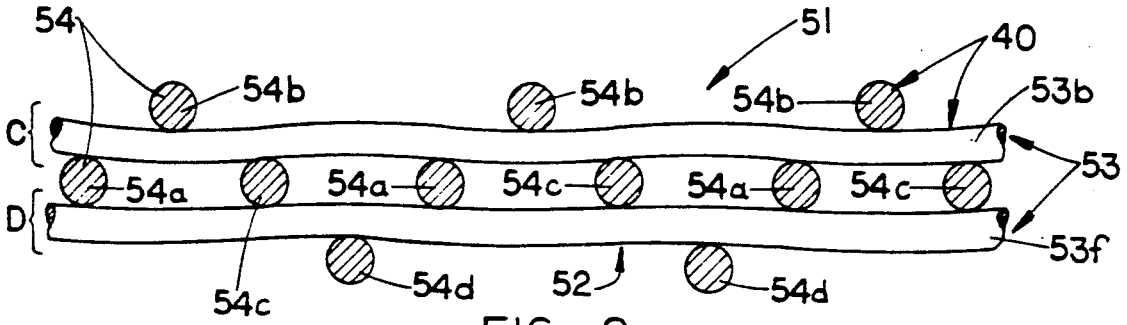
FIG. 8 is an extended sectional view taken along line 8—8 of FIG. 7.
Figure 9:
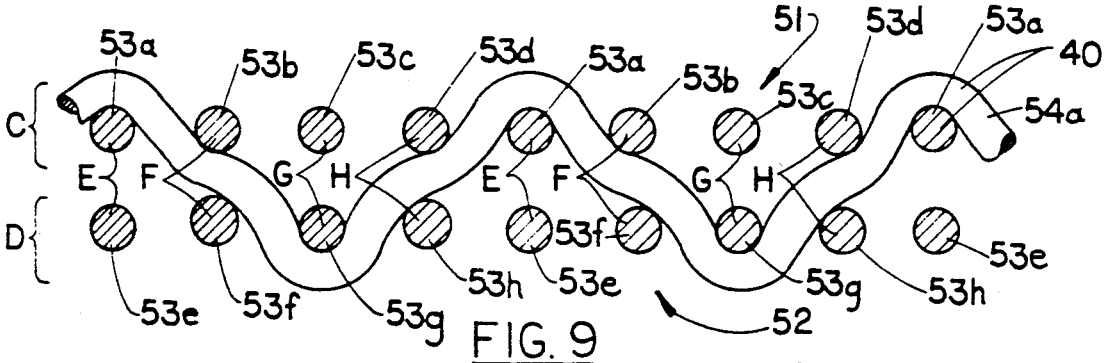
FIG. 9 is an end sectional view of the woven reinforcing structure of FIG. 7.
Figure 10:
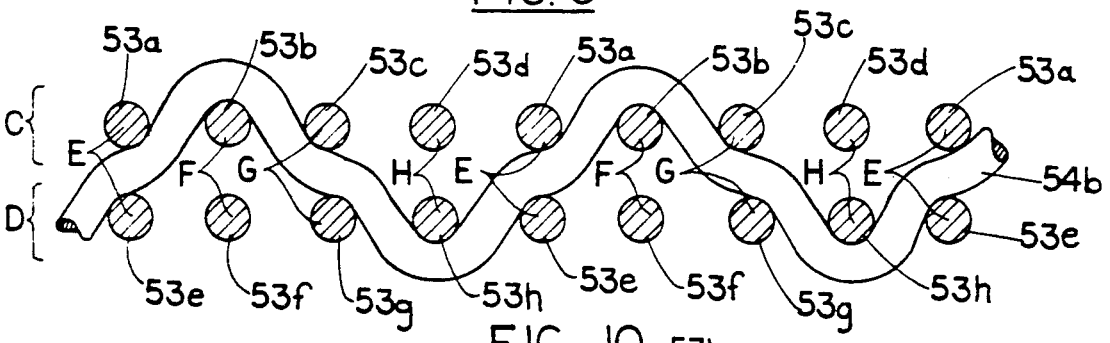
FIG. 10 is a sectional view taken along line 10—10 of FIG. 7.
Figure 11:
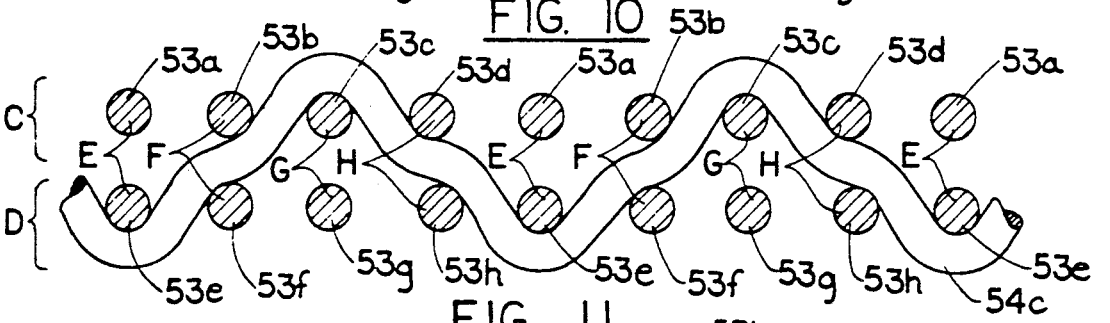
FIG. 11 is a sectional view taken along line 11—11 of FIG. 7.

FIGS. 7 through 12 illustrate one such preferred multilayer belt suitable for use in the present invention. The reinforcing structure 33 illustrated in FIGS. 7 through 12 is a highly permeable woven multilayer reinforcing structure for use in a papermaking fabric, or by itself as a papermaking fabric, which has increased fabric stability in the machine direction. As best seen in FIGS. 8 and 9, this preferred fabric includes a paper support side 51 and a roller contact side 52 which facilitates travel as an endless belt in the machine direction.

Figure 12:
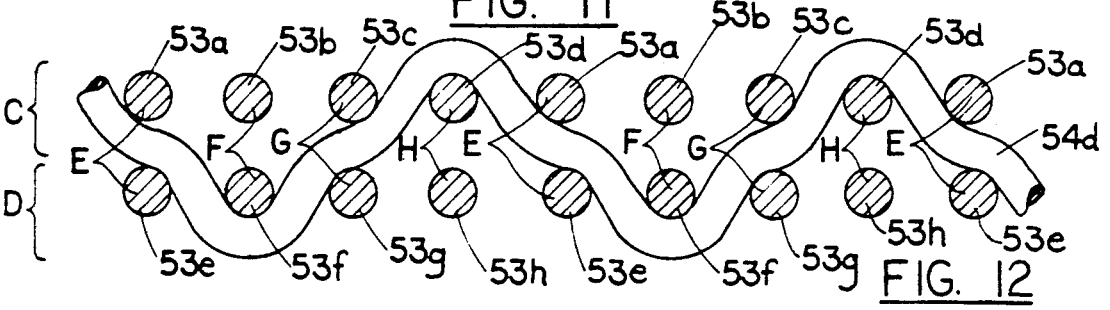
FIG. 12 is a sectional view taken along line 12—12 of FIG. 7.

The fabric illustrated in FIGS. 7 through 12 comprises a first warp layer C of first load-bearing warp yarns, which are numbered repeatedly across the fabric as 53*a*, 53*b*, 53*c*, and 53*d*, and a second layer D of second load-bearing warp yarns, which are numbered repeatedly across the fabric as 53*e*, 53*f*, 53*g*, and 53*h*, extending in the machine direction on the roller contact side 52 of the fabric. As best seen in FIGS. 9 through 12, the individual yarns in the first warp layer C and the second warp layer D define stacked warp yarn pairs E, F, G, and H which are arranged in a generally vertically-stacked superposed position one over the other. More specifically, it is seen that: warp yarns 53*a* and 53*e* define stacked warp yarn pair E; warp yarns 53*b* and 53*f* define stacked warp pair F; warp yarns 53*c* and 53*g* define stacked warp pair G; and, warp yarns 53*d* and 53*h* devine stacked warp pair H. The adjacent stacked warp yarn pairs are spaced apart in a cross-machine direction to provide a desired fabric open area. A warp balancing weft yarn, 53*a* in FIG. 9, 54*b* in FIG. 10, 54*c* in FIG. 11, and 54*d* in FIG. 12 is interwoven with the first and second warp layers to bind the respective individual warp yarns in the first and second warp yarn layers in stacked pairs. These warp balancing weft yarns are also numbered repeatedly across the fabric. The warp balancing weft yarn is interwoven in a warp balance weave pattern with the stacked pairs of warp yarns which maintains the warp yarns stacked upon one another and in general vertical alignment in the weave pattern. The fabric thus formed has increased fabric stability in the machine direction and a high degree of openness and permeability.

In addition, the yarns and the knuckles of the reinforcing structure 33 define several planes which will be of interest in describing the location and characteristics of the surface texture irregularities 38 on the second surface 35 of the framework 32. The surface texture irregularities 38 (or backside texture) present in the preferred embodiment of the papermaking belt 10 are first illustrated in FIG. 5. By "backside texture", it is meant that these portions of varying height in the second surface 12 of the papermaking belt 10 which are distinct from the conduits, and which are at locations which are either not necessarily dependent upon, or are independent of the location of the body of the reinforcing structure 33. By "not necessarily dependent", it is meant that the location of the backside texturing is not necessarily tied in any manner to the location of the reinforcing structure 33.

The surface texture irregularities 38 are comprised of the same material as the framework 32, thus the surface texture can be any irregularities discontinuities or breaks in the resinous material which forms the second surface network 35*a*, or any portions of the backside network surface where resin has been removed.

4. Process for Making the Papermaking Belt

As indicated above, papermaking belt 10 can take a variety of forms. While the method of construction of the papermaking belt 10 is immaterial so long as it has the characteristics mentioned above, the following methods have been discovered to be useful. A detailed description of the process of making the papermaking belt 10 without the improvements disclosed herein is set forth in U.S. Pat. No. 4,514,345, entitled "Method of Making a Foraminous Member" which issued to Johnson, et al. on Apr. 30, 1985, incorporated by reference herein. One process of making the papermaking belt 10 is described below.

Figure 13:
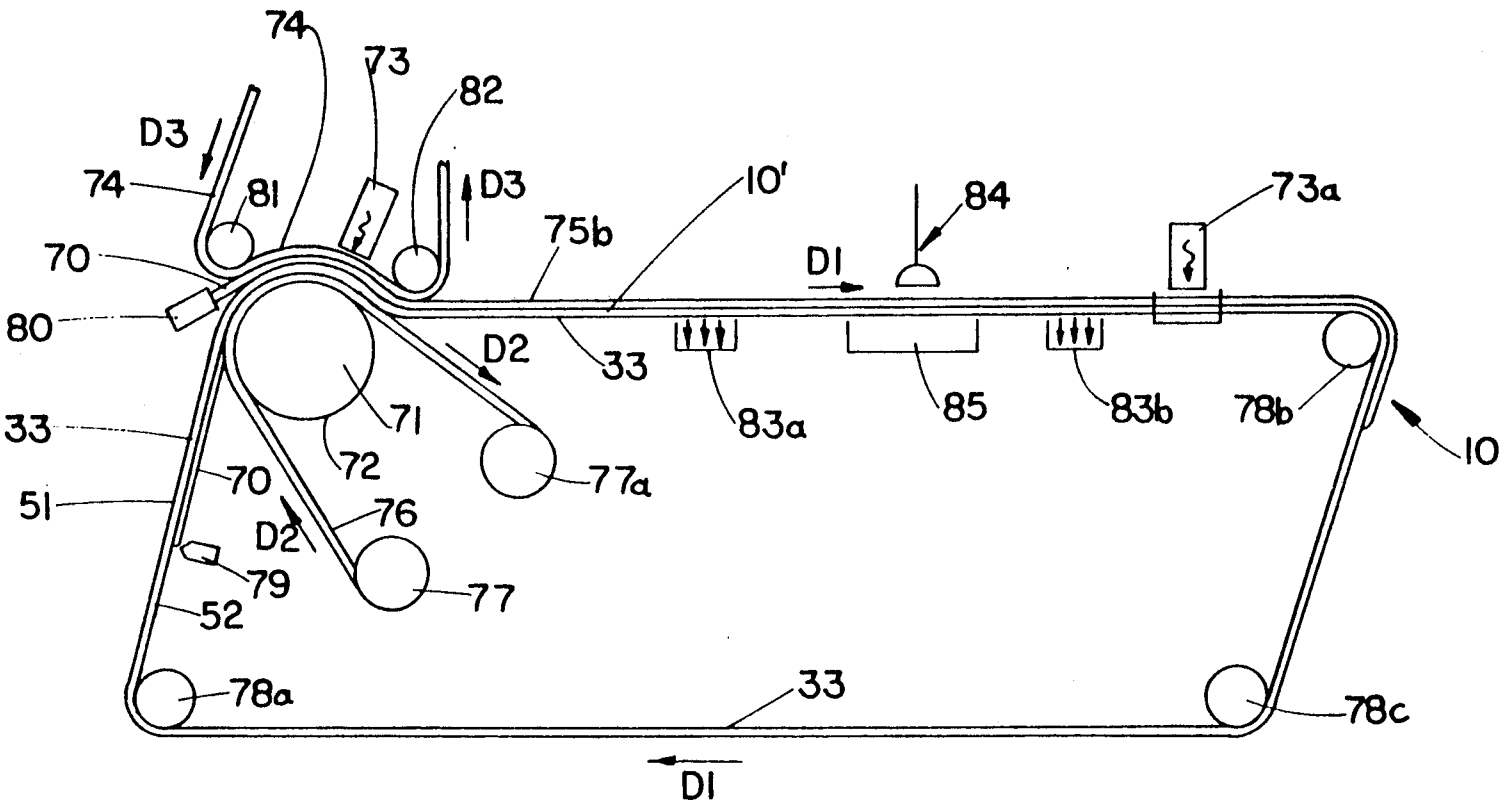
FIG. 13 is a schematic representation of the basic apparatus for making the papermaking belt used in the practice of the present invention.

A preferred embodiment of an apparatus which can be used in the practice of this invention to construct the papermaking belt 10 of the present invention in the form of an endless belt is shown in schematic outline in FIG. 13. In order to show an overall view of the entire apparatus for constructing a papermaking belt in accordance with the present invention, FIG. 13 was simplified to a certain extent with respect to some of the details of the process. The overall process shown in FIG. 13 generally involves coating the reinforcing structure 33 with a photosensitive resin 70 when the reinforcing structure 33 is traveling over a forming unit or table 71 which is covered by a backing film 76 which (among other things) prevents the working surface 72 of the forming unit 71 from being contaminated with resin; controlling the thickness of the photosensitive resin 70 to a preselected value; exposing the resin 70 to a light having an activating wavelength (from a light source 73) through a mask 74 having opaque 74*a* and transparent regions 74*b*; and, removing the uncured resin 75.

In FIG. 13, forming unit 71 has a working surface 72 and is indicated as being a circular element; it is preferably a drum. The diameter of the drum and its length are selected for convenience. Its diameter should be great enough so that the backing film 76 and the reinforcing structure 33 are not unduly curved during the process. It must also be large enough in diameter so there is sufficient distance of travel about its surface so that the necessary steps can be accomplished as the drum is rotating. The length of the drum is selected according to the width of the papermaking belt 10 being constructed. The forming unit 71 is rotated by a drive means not illustrated. Optionally, and preferably, the working surface 72 absorbs light of the activating wavelength.

As noted above, the forming unit 71 is covered by a backing film 76 which prevents the working surface 72 of the forming unit 71 from being contaminated with resin. Another purpose of the backing film 76 is to facilitate the removal of the partially completed papermaking belt 10 from the forming unit. Generally, the backing film can be any flexible, smooth, planar material such as polyethylene or polyester sheeting. Preferably, the backing film is made from polypropylene and is from about 0.01 to about 0.1 millimeter (mm) thick. Preferably, the backing film 76 also absorbs light of the activating wavelength.

In the apparatus shown in FIG. 13, the backing film 76 is introduced into the system from the backing film supply roll 77 by unwinding it and causing it to travel in the direction indicated by directional arrow D2. After unwinding, the backing film 76: contacts the working surface 72 of forming unit 71; is temporarily constrained against the working surface 72 (by means discussed below). The backing film 76 then travels with the forming unit 71 as the forming unit 71 rotates. The backing film 76 is eventually separated from the working surface 72; and travels to the backing film take-up roll where it is rewound. In the embodiment of the process illustrated in FIG. 13, the backing film is designed for a single use after which it is discarded. In an alternative arrangement, the backing film takes the form of an endless belt traveling about a series of return rolls where it is cleaned as appropriate and reused. Necessary drive means, guide rolls, and the like are not illustrated in FIG. 13.

Preferably, the forming unit 71 is provided with a means for insuring the backing film 76 is maintained in close contact with the working surface 72. The backing film 76 can be, for example, adhesively secured to the working surface 72, or the forming unit 71 can be provided with a means for securing the backing film 76 to the working surface 72 through the influence of a vacuum applied through a plurality of closely spaced, small orifices distributed across the working surface 72 of the forming unit 71. Preferably, the backing film 76 is held against the working surface 72 by a conventional tensioning means which is not shown in FIG. 13.

The second step of the process of the present invention is the providing of a reinforcing structure for incorporation into the papermaking belt. As noted above, the reinforcing structure 33 is the material about which the papermaking belt 10 is constructed. The preferred reinforcing structure 33 shown in FIGS. 7 to 12 is a woven, multilayer fabric characterized by warp strands which are vertically stacked directly on top of one another. The vertically-stacked warp yarns provides increased stability for the fabric in the machine or process direction, while at the same time do not decrease the projected open area of the fabric needed to allow the same to be used in blow through drying papermaking processes.

Since the papermaking belt 10 is constructed by the apparatus illustrated in FIG. 13 is in the form of an endless belt, reinforcing structure 33 should also be an endless belt. As illustrated, reinforcing structure 33 travels in the direction indicated by directional arrow DI about return roll 78*a* up, over, and about forming unit 71 and about return rolls 78*b* and 78*c*. Other guide rolls, return rolls, drive means, support rolls and the like are not shown in FIG. 13.

The third step of the process of the present invention is the placing of the reinforcing structure 33 on the working surface 72 of the forming unit 71 (or more particularly in the case of the embodiment illustrated, traveling the reinforcing structure 33 over the working surface 72 of the forming unit 71). As noted above, preferably a backing film 76 is used to keep the working surface 72 of the forming unit 71 free of resin 70. In this case, the third step will involve placing the reinforcing structure 33 adjacent to the backing film in such a way that the backing film 76 is interposed between the reinforcing structure 33 and the forming unit 72.

The specific design desired for the papermaking belt 10 will dictate the exact manner in which the reinforcing structure 33 is positioned relative to either the working surface 72 of the forming unit 71 or the backing film 76. In one embodiment of the present invention, the reinforcing structure 33 is placed in direct contacting relation with backing film 76. In another embodiment of the present invention, the reinforcing structure 33 can be spaced some finite distance from backing film 76 by any convenient means. One situation in which the reinforcing structure 33 is spaced away from the working surface 72 of the forming unit 71 (or if a backing film is used, from the backing film 76) occurs, as will be hereinafter seen, when photosensitive liquid resin 70 is applied to the backside 52 of the reinforcing structure 33.

The third step in the process is the application of a coating of liquid photosensitive resin 70 to the reinforcing structure 33. Any technique by which the liquid material can be applied to the reinforcing structure 33 is suitable. In the preferred method, however, the liquid photosensitive resin is applied to the reinforcing structure 33 at two stages. The first stage at which resin is applied is at the place indicated by extrusion header 79. The application of resin by extrusion header 79 is employed in conjunction with the application of resin at a second stage by nozzle 80. At the first stage, extrusion header 79 is used to fill the interstices in the reinforcing structure 33 from the backside. This permits a suitable amount of photosensitive resin to adhere to the backside of the reinforcing structure 33 so the same can be imparted with a texture on the backside in the steps which will be subsequently described. It is necessary that liquid photosensitive resin 70 be evenly applied across the width of reinforcing structure 33 and that the requisite quantity of material be worked through the interstices 39 and into all available void volume of the reinforcing structure 33 as the design of the papermaking belt 10 requires.

For coating the reinforcing structure 33, suitable photosensitive resins can be readily selected from the many available commercially. Photosensitive resins which can be used are materials, usually polymers, which cure or cross-link under the influence of radiation, usually ultraviolet (UV) light. Examples of photosensitive polymeric resins include: acrylated urethanes (e.g., methacrylated urethane), styrene butadiene copolymers, acrylic esters, epoxy acrylates, acrylated aromatic urethanes, acrylated polybutadienes, and methacrylated urethanes. References containing a more complete disclosure of suitable liquid photosensitive resins include Green et al., "Photocross-linkable Resin Systems", J. Macro-Sci. Revs. Macro Chem. C21 (2), 187–273 (1981–82); Bayer, "A Review of Ultraviolet Curing Technology", Tappi Paper Synthetics Conf. Proc., Sept. 25–27, 1978, pp. 167–172; and Schmidle, "Ultraviolet Curable Flexible Coatings", J. of Coated Fabrics, 8, 10–20 (July, 1978). All the preceding three references are incorporated herein by reference. Especially preferred liquid photosensitive resins are included in the Merigraph series of methacrylated urethane resins made by Hercules Incorporated, Wilmington, Del. A most preferred methacrylated resin is Merigraph resin EPD 1616B.

In the preferred process of carrying out the present invention, antioxidants are added to the resin to protect the finished papermaking belt 10 from oxidation and increase the life of the papermaking belt. Any suitable antioxidants can be added to the resin. The preferred antioxidants are Cyanox 1790, which is available from American Cyanamid of Wayne, N.J. 07470, and Irganox 1010, which is made by Ciba Geigy of Ardsley, N.Y. 10502. In the preferred process for making the papermaking belt 10 both antioxidants are added to the resin. The antioxidants are added in the following respective amounts, Cyanox 1790 1/10 of 1%, and Irganox 1010 4/10 of 1%. Both antioxidants are added so the papermaking belt 10 is protected from several different species of oxidizing agents.

The next step (i.e., the fifth step) in the process is controlling the thickness of the coating to a preselected value. The preselected value corresponds to the thickness desired for the papermaking belt 10. This thickness, also naturally, follows from the expected use of the papermaking belt. When the papermaking belt 10 is to be used in the papermaking process described hereinafter, it is preferred that the thickness be from about 0.01 mm to about 3.0 mm. Other applications, of course, can require thicker papermaking fabrics which can be 3 centimeters thick or thicker. Any suitable means for controlling the thickness can be used. Illustrated in FIG. 13 is the use of nip roll 81 which also serves as a mask guide roll. The clearance between nip roll 81 and forming unit 71 can be controlled mechanically by conventional means not shown. The nip roll 81, in conjunction with mask 74 and mask guide roll 82, tends to smooth the surface of liquid photosensitive resin 70 and to control its thickness.

The sixth step in the process comprises positioning a mask 74 in contacting relation with the liquid photosensitive resin 70. The purpose of the mask 74 is to shield certain areas of the liquid photosensitive resin from exposure to light. Naturally, if certain areas are shielded, it follows that certain areas are not shielded and that the liquid photosensitive resin 70 in those unshielded areas will be exposed later to activating light and will be cured. The shaded regions normally comprise the preselected pattern formed by the conduits 36 in the hardened resin framework 32.

Mask 74 can be any suitable material which can be provided with opaque regions 74*a* and transparent regions 74*b*. A material in the nature of a flexible photographic film is suitable. The flexible film can be polyester, polyethylene, or cellulosic or any other suitable material. The opaque regions 74*a* can be applied to mask 74 by any convenient means such as photographic or gravure, flexographic, or rotary screen printing. Mask 74 can be an endless loop or it can be supplied from one supply roll and transverse the system to a takeup roll, neither of which is shown in the illustration. Mask 74 travels in the direction indicated by directional arrow D3, turns under nip roll 81 where it is brought into contact with the surface of liquid photosensitive resin 70, and then travels to mask guide roll 82 in the vicinity of which it is removed from contact with the resin 70. In this particular embodiment, the control of the thickness of the resin and the positioning of the mask occur simultaneously.

The seventh step of the process comprises exposing the liquid photosensitive resin to light of an activating wavelength through the mask thereby inducing curing of the resin in those regions which are in register with the transparent regions **74*b* with the mask. In the embodiment illustrated in FIG. 13, backing film 76, reinforcing structure 33, liquid photosensitive resin 70, and mask 74 all form a unit traveling together from nip roll 81 to the vicinity of mask guide roll 82. Intermediate nip roll 81 and mask guide roll 82 are positioned at a location where backing film 76 and reinforcing structure 33 are still adjacent the forming unit 71, the liquid photosensitive resin 70 is exposed to light of an activating wavelength which is supplied by exposure lamp 73. Exposure lamp 73, in general, is selected to provide illumination primarily within the wavelength which causes curing of the liquid photosensitive resin 70. That wavelength is a characteristic of the liquid photosensitive resin 70. Any suitable source of illumination, such as mercury arc, pulsed xenon, electrodeless, and fluorescent lamps, can be used. As described above, when the liquid photosensitive resin 70 is exposed to light of the appropriate wavelength, curing is induced in the exposed portions of the resin 70**. Curing is generally manifested by a solidification of the resin in the exposed areas. Conversely, the unexposed regions remain fluid.

The intensity of the illumination and its duration depend upon the degree of curing required in the exposed areas. The absolute values of the exposure intensity and time depend upon the chemical nature of the resin, its photo characteristics, the thickness of the resin coating, and the pattern selected. Further, the intensity of the exposure and the angle of incidence of the light can have an important effect on the presence or absence of taper in the walls of the preselected pattern of the conduits 36.

In the preferred embodiment of the present invention, the angle of incidence of the light is collimated to better cure the photosensitive resin in the desired areas, and to obtain the desired angle of taper in the walls of the finished papermaking fabric. Other means of controlling the direction and intensity of the curing radiation, include means which employ refractive devices (i.e., lenses), and reflective devices (i.e., mirrors). The preferred embodiment of the present invention employs a subtractive collimator (i.e., an angular distribution filter or a collimator which filters or blocks ultraviolet light rays in directions other than those desired). Any suitable device can be used as a subtractive collimator. A dark colored, preferably black, metal device formed in the shape of a series of channels through which light directed in the desired direction may pass is preferred. In the preferred embodiment of the present invention, the collimator is of such dimensions that it transmits light so the resin network when cured has a projected surface area of 35% on the topside of the papermaking belt, and 65% on the backside.

The eighth and last step in the process is removing from the reinforcing structure 33 substantially all of the uncured liquid photosensitive resin. In other words, the resin which has been shielded from exposure to light is removed from the system.

In the embodiment shown in FIG. 13, at a point in the vicinity of mask guide roll 82, mask 74 and backing film 76 are physically separated from the composite comprising reinforcing structure 33 and the now partly cured resin **70*a*. The composite of reinforcing structure 33 and partly cured resin 70*a* travels to the vicinity of the first resin removal shoe 83*a*. A vacuum is applied to one surface of the composite at first resin removal shoe 83*a*** so that a substantial quantity of the liquid (uncured) photosensitive resin is removed from the composite.

As the composite travels farther, it is brought into the vicinity of resin wash shower 84 and resin wash station drain 85 at which point the composite is thoroughly washed with water or other suitable liquid to remove essentially all of the remaining liquid (uncured) photosensitive resin **75*a* which is discharged from the system through resin wash station drain 85. At second resin removal shoe 83*b*, any residual wash liquid and liquid resin is removed from the composite by the application of vacuum. At this point, the composite now comprises essentially reinforcing structure 33 and the associated framework 32 and represents the papermaking belt 10 which is the product of this process. Optionally, and preferably, as shown in FIG. 13** as there can be a second exposure of the resin to activating light so as to complete the curing of the resin and to increase the hardness and durability of the cured resin framework.

The process continues until such time as the entire length of reinforcing structure 33 has been treated and converted into the papermaking belt 10.

Should it be desired to construct a member having different patterns superimposed one on another or having patterns of different thicknesses, the member can be subjected to multiple passes through the process. Multiple passes through the process described above can also be used to construct papermaking fabrics of relatively great thickness.

A preferred method for forming an improved papermaking belt 10 having a textured backside involves the use of a woven element (or nonwoven element) which is constructed of strands with differing ultraviolet light transmission characteristics. This method will be referred to as "Differential Transmission Casting". In Differential Transmission Casting, the foraminous woven element is constructed in such a manner that the strands on top of the foraminous woven element transmit ultraviolet light to a high degree, while the strands on the bottom or backside do not transmit, but instead absorb ultraviolet light. This causes the ultraviolet light to be transmitted throughout the photosensitive resin network except in the portion of the network which lies under the bottom strands. As a result, the photosensitive resin which lies under the bottom strands is not cured, and can be removed during the final step set out above, leaving a series of depressions in the backside of the papermaking belt 10 under the absorptive strands.

It is believed that the process of the present invention of adding chemicals to a resin coated papermaking belt during the papermaking operation to extend the belt's useful life will be understood from the foregoing detailed description. However, it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

By way of illustration, and not by way of limitation, the following example is presented.

EXAMPLE I

A pilot scale Fourdrinier papermaking machine is used in the practice of the present invention. The headbox is a fixed roof suction breast roll former. The furnish comprises 100% northern softwood Kraft pulp fibers with about 10 kilograms Kymene TM 557 H wet strength resin additive per 1,000 kilograms bone-dry fibers (Kymene TM 557H is made by Hercules, Inc. of Wilmington, Del.). An aqueous fibrous slurry, having a fiber consistency of about 0.15% is deposited onto the Fourdrinier wire. Dewatering occurs through the Fourdrinier wire and is assisted by a deflector and vacuum boxes. The Fourdrinier wire is of a 5-shed, satin weave configuration having 33 machine-direction and 30 cross-machine-direction monofilaments per centimeter, respectively. The embryonic wet web is transferred from the Fourdrinier wire, at a fiber consistency of about 18% at the point of transfer, to a second papermaking belt. The second papermaking belt is an endless belt having the preferred network surface and deflection conduits described in conjunction with FIGS. 2 and 6 above. The papermaking belt is formed about a foraminous woven element made of polyester and having 14 (MD) by 12 (CD) filaments per centimeter in a four shed dual layer design (as illustrated in FIGS. 7-12) according to the process disclosed in U.S. Pat. No. 4,514,345. The filaments are about 0.22 mm in diameter machine-direction and 0.28 mm in diameter cross-machine-direction. The photosensitive resin used in the process is Merigraph resin EPD1616B, a methacrylated-urethane resin marketed by Hercules, Incorporated, Wilmington, Del. The papermaking belt is about 1.1 mm thick.

The embryonic web is carried on the papermaking belt past the vacuum dewatering box, through blow-through predryers after which the web is transferred onto a Yankee dryer. The other process and machine conditions are listed below. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray applied by applicators; the fiber consistency is increased to be an estimated 99% before dry creping the web with a doctor blade. The doctor blade has a bevel angle of about 24 degrees and is positioned with respect to the Yankee dryer to provide an impact angle of about 83 degrees; the Yankee dryer is operated at about 350° F. (177° C.); the Yankee dryer is operated at about 800 fpm (feet per minute) (about 244 meters per minute) The dry creped web is then passed between two calender rolls. The two calender rolls are biased together at roll weight and operated at surface speeds of 660 fpm (about 201 meters per minute). The calendered web is wound on a reel (which is also operated at a surface speed of 660 fpm) and is then ready for use.

An aqueous solution containing an antioxidizing emulsion is continuously applied onto the paper-contacting surface of the papermaking belt via an emulsion distribution roll before the papermaking belt comes in contact with the embryonic web (e.g., see location of emulsion distributing roll 23 in FIG. 1). The aqueous emulsion applied by the distribution roll onto the deflection member contains five ingredients: water, Regal Oil (a high-speed turbine oil marketed by the Texaco Oil Company), AROSURF TA 100 (a dimethyl-distearyl ammonium chloride surfactant marketed by the Sherex Chemical Company, cetyl alcohol (a $C_{16}$ linear fatty alcohol marketed by The Procter & Gamble Company), and Cyanox 1790, a hindered-phenol type primary antioxidant from American Cyanamid Company. The relative proportions of the five ingredients are as follows: 10% by weight Regal Oil, 1% by weight Arosurf, 0.9% by weight cetyl alcohol, 1.25% by weight of oil Cyanox 1790, and the remainder water. In preparation of the emulsion, the Cyanox 1790 is first dissolved in the Regal Oil by heating the oil to 165° F. for 5 minutes. The oil phase of the emulsion is next mixed with the surfactants listed above, and finally with water. The volumetric flow rate of the aqueous solution applied to the papermaking belt is about 0.50 gal/hr.-cross-direction ft. (about 6.21 liters/hr-meter).

The aqueous solution containing the antioxidizing emulsion is applied continuously to the paper-contacting surface of the belt over its entire lifetime. This ensures that the antioxidant content of the papermaking belt is sufficient to protect the resin containing papermaking belt against oxidation [about a 0.1% concentration of antioxidant has been determined to be optimum]. Importantly, the papermaking belt has an improved useful life as a result of this process.

What is claimed is:

1. A process for extending the life of papermaking belts containing a solid polymeric resin which has been rendered solid by exposing a liquid photosensitive resin to light of an activating wavelength, which process comprises the steps of:

a) providing a papermaking belt, said papermaking belt containing a solid polymeric resin which has been rendered solid by exposing a liquid photosensitive resin to light of an activating wavelength; and b) continuously applying a release emulsion comprising water, oil, surfactant, and an effective amount of an antioxidant chemical compound capable of inhibiting or retarding the oxidation rate of said solid polymeric resin to the papermaking belt, said release emulsion being continuously applied to the papermaking belt while the belt is being used in a papermaking machine, at a point where the belt is not in contact with a paper web, wherein said antioxidant chemical compound is selected from the group consisting of hindered phenols, secondary amines, and mixtures thereof, and wherein said antioxidant chemical is dissolved in the oil phase of the release emulsion.

2. The process of claim 1 wherein the antioxidant chemical compound is an hindered phenol.

3. The process of claim 1 wherein said papermaking belt comprises:

a framework having a paper-contacting first surface, a second surface opposite said first surface, and conduits extending between said first surface and said second surface, said framework comprised of said solid polymeric resin; and a reinforcing structure for reinforcing said framework, said reinforcing structure positioned between said first surface of said framework and at least a portion of said second surface of said framework.

4. The process of claim 3 wherein said reinforcing structure is a foraminous woven element.

5. The process of claim 4 wherein said solid polymeric resin is an acrylated urethane.

6. The process of claim 5 wherein said acrylated urethane is a methacrylated-urethane.

7. The process of claim 5 wherein said antioxidant chemical is a hindered phenol.

8. The process of claim 7 further comprising applying a secondary antioxidant selected from the group consisting of phosphites, thioesters, and mixtures thereof.

9. The process of claim 5 wherein the antioxidant chemical is applied to the paper-contacting surface of said papermaking belt.

10. The process of claim 9 wherein the antioxidant chemical is a hindered phenol.

11. The process of claim 10 wherein the solid polymeric resin is a methacrylate-urethane and wherein the antioxidant chemical comprises a mixture of hindered phenols.

12. The process of claim 11 comprising applying a secondary antioxidant which is a thioester.

* * * * *

UNITED STATES PATENT AND TRADEMARK OFFICE

CERTIFICATE OF CORRECTION

PATENT NO. 5,073,235

DATED December 17, 1991

INVENTOR(S) Paul D. Trokhan

It is certified that error appears in the above-identified patent and that said Letters Patent is hereby corrected as shown below:

Column 17, line 20 "ID" should read --1D--.

Column 17, line 21 both occurrences "ID" should read --1D--.

Column 19, line 55 insert after "surface" --11--.

Column 24, line 58 "devine" should read --define--.

Column 27, line 4 "DI" should read --D1--.

Signed and Sealed this

Sixteenth Day of May, 1995

*Attest:*

Bruce Lehman

BRUCE LEHMAN

*Attesting Officer*

*Commissioner of Patents and Trademarks*